US007173224B2

(12) United States Patent
Kataoka et al.

(10) Patent No.: US 7,173,224 B2
(45) Date of Patent: Feb. 6, 2007

(54) INDUCTION HEATING APPARATUS HAVING ELECTROSTATIC SHIELDING MEMBER

(75) Inventors: Akira Kataoka, Sanda (JP); Izuo Hirota, Toyonaka (JP); Katsuyuki Aihara, Akashi (JP); Nobuyoshi Makio, Miki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 15 days.

(21) Appl. No.: 11/286,666

(22) Filed: Nov. 23, 2005

(65) Prior Publication Data

US 2006/0081615 A1 Apr. 20, 2006

Related U.S. Application Data

(63) Continuation of application No. 10/507,990, filed as application No. PCT/JP03/03333 on Mar. 19, 2003.

(30) Foreign Application Priority Data

Mar. 19, 2002 (JP) ..... 2002-075752

(51) Int. Cl.
*H05B 6/12* (2006.01)

(52) U.S. Cl. ..... 219/620; 219/622

(58) Field of Classification Search ..... 219/620–627; 99/DIG. 14, 457
See application file for complete search history.

(56) References Cited

U.S. PATENT DOCUMENTS

| | | | | |
|---|---|---|---|---|
| 4,013,859 | A * | 3/1977 | Peters, Jr. | 219/626 |
| 4,163,139 | A | 7/1979 | Malarkey et al. | |
| 6,793,865 | B2 * | 9/2004 | Kapteyn et al. | 264/400 |
| 7,009,159 | B2 * | 3/2006 | Kataoka et al. | 219/622 |
| 7,049,564 | B2 * | 5/2006 | Takada et al. | 219/627 |

FOREIGN PATENT DOCUMENTS

| | | |
|---|---|---|
| JP | 53-19149 | 7/1976 |
| JP | 62-278785 | 12/1978 |
| JP | 56-49089 | 7/1979 |
| JP | 54-149954 | 11/1979 |
| JP | 55-000689 | 1/1980 |
| JP | 58-48388 | 3/1983 |
| JP | 59-103295 | 6/1984 |
| JP | 59-159889 | 10/1984 |
| JP | 1-120789 | 5/1989 |
| JP | 04-075634 | 3/1992 |
| JP | 04-169091 | 6/1992 |
| JP | 10-199668 | 7/1998 |
| JP | 2003-347025 | 12/2003 |

* cited by examiner

*Primary Examiner*—Daniel Robinson
(74) *Attorney, Agent, or Firm*—Pearne & Gordon LLP

(57) ABSTRACT

An induction heating apparatus with high safety is provided in which leakage current is prevented from flowing to the human body and there is no possibility of an electric shock even when an electrostatic shielding member does not sufficiently perform its function. The driving apparatus of the present invention is an induction heating apparatus in which the electrostatic shielding member is provided between an object to be heated and an induction heating coil where sensing portion for sensing the conduction condition of the electrostatic shielding member is provided, and driving portion for driving the induction heating coil is controlled through sensing by the sensing portion.

8 Claims, 13 Drawing Sheets

INDUCTION HEATING APPARATUS HAVING ELECTROSTATIC SHIELDING MEMBER

CROSS-REFERENCE TO RELATED APPLICATION

This application is a continuation of U.S. Ser. No. 10/507,990, filed on Sep. 16, 2004, which is a 371 of International Application No. PCT/JP03/03333, filed Mar. 19, 2003.

TECHNICAL FIELD

The present invention relates to an induction heating apparatus in which a shielding member is provided between an object to be heated and an induction heating coil.

BACKGROUND ART

An induction heating apparatus applying induction heating and using an inverter has excellent heating response and controllability by providing a temperature sensor or the like in the vicinity of a pan or the like that serves as the load, sensing pan temperatures or the like, and making an adjustment of the heating power and an adjustment of the cooking time in accordance therewith. The induction heating apparatus realizes delicate cooking, and has characteristics such that it hardly pollutes the air in the room since no flame is used, that it is high in thermal efficiency and that it is safe and clean. In recent years, attention has been paid to these characteristics, and demand for the induction heating apparatus has been rapidly growing.

An induction heating apparatus of a first conventional example will be described referring to FIG. 14. The induction heating apparatus of the first conventional example is capable of heating high-permeability (magnetic) objects to be heated, such as iron (or low-permeability and high-resistance objects to be heated, such as 18-8 stainless steel) and low-permeability (non-magnetic) and low-resistance objects to be heated, such as aluminum or copper. FIG. 14 is a block diagram showing the structure of the induction heating apparatus of the first conventional example. In FIG. 14, reference numeral 110 represents an object to be heated (a metal vessel such as a pan or a frying pan), reference numeral 101 represents an induction heating coil that generates a high-frequency magnetic field and heats the object 110 to be heated, reference numeral 127 represents a commercial AC source input, reference numeral 108 represents a rectification and smoothing portion that comprises a bridge 108*a* and a smoothing capacitor 108*b* and rectifies the commercial AC source, reference numeral 1402 represents an inverter circuit that converts the power source rectified by the rectification and smoothing portion 108 to high-frequency power and supplies a high-frequency current to the induction heating coil 101, reference numeral 105 represents a microcomputer, reference numeral 1409 represents an operation portion, and reference numeral 125 represents a cabinet. Reference numeral 118 represents a ceramic top plate disposed on the top surface of the cabinet 125, and on which the object 110 to be heated is placed.

The microcomputer 105 has a control portion 104. The operation portion 1409 has a setting input portion 113 and a setting display portion 114. The setting input portion 113 has a plurality of key switches (including a key switch for inputting an instruction to set the output stage that determines the target output of the induction heating apparatus, a key switch for inputting an instruction to turn on the induction heating apparatus, and a key switch for inputting an instruction to turn off the induction heating apparatus).

The setting display portion 114 has a plurality of visible LEDs (light emitting diodes), and displays the setting condition of the induction heating apparatus.

The control portion 104 drives a driving circuit 111 in response to the instruction inputted from the setting input portion 113. The driving circuit 111 controls the output of the inverter circuit 102. The control portion 104 controls the ON/OFF of a relay (not shown) when a low-permeability and low-resistance object to be heated is heated and when a high-permeability object to be heated (or a low-permeability and high-resistance object to be heated) is heated, thereby switching the number of turns of the induction heating coil 101 operated by the inverter circuit 102 and switching the voltage applied to the induction heating coil 101. The number of turns of the induction heating coil 101 is larger and the voltage applied to the induction heating coil 101 is higher when a low-permeability and low-resistance object to be heated is heated than when a high-permeability object to be heated (or a low-permeability and high-resistance object to be heated) is heated. When the object 110 to be heated is a pan made of aluminum, copper or the like that is low in permeability and low in resistance, the voltage applied to the induction heating coil 101 is not less than 1 kV.

A stray capacitance (equivalent capacitance) 1411 is present between the induction heating coil 101 and the object 110 to be heated. When the user touches the object 110 to be heated, current flows from the induction heating coil 101 to ground through the stray capacitance 1411 and the internal resistance (equivalent resistance) 1412 of the user's body. It is dangerous if current of not less than a predetermined level leaks from the high-voltage induction heating coil 101 to the human body.

Japanese Published Patent Application No. H04-75634 describes an induction heating cooker of a second conventional example that prevents current from leaking from the high-voltage induction heating coil 101 to the human body. The induction heating cooker of the second conventional example will be described referring to FIGS. 15 and 16. FIG. 15 is a block diagram showing the structure of the induction heating cooker of the second conventional example. In FIG. 15, the same blocks as those of the first conventional example (FIG. 14) are denoted by the same reference numerals. The induction heating cooker of the second conventional example is different from the first conventional example in that a conductive electrostatic shielding member 1512 and an insulating layer 1513 covering the electrostatic shielding member 1512 are provided on the undersurface of the top plate 118. The electrostatic shielding member 1512 is connected to a low-potential part of the rectification and smoothing portion 108. Except this, the second conventional example is the same as the first conventional example.

FIG. 16 is a view showing the pattern of the electrostatic shielding member 1512 formed on the top plate 118 of the induction heating cooker of the second conventional example. For ease of understanding, FIG. 16 shows the pattern of the electrostatic shielding member 1512 excluding the insulating layer 1513. The electrostatic shielding member 1512 is applied to the undersurface of the top plate 118 and fixed by baking. The electrostatic shielding member 1512 has an annular shape. The connecting wire from the low-potential part of the rectification and smoothing portion 108 is connected to an electrode 1513 of the electrostatic shielding member 1512.

A stray capacitance (equivalent capacitance) 1514 is present between the induction heating coil 101 and the electrostatic shielding member 1512. Current flows from the induction heating coil 101 to ground through the stray capacitance 1514 and an internal resistance (equivalent resistance) 1515 of the electrostatic shielding member 1512. The impedance of the internal resistance (equivalent resistance) 1515 of the conductive electrostatic shielding member 1512 is sufficiently low compared to the impedance of the stray capacitance (equivalent capacitance) 1514 (the frequency of the high-frequency current flowing through the induction heating coil 101 is approximately 20 to 60 kHz). Therefore, the voltage induced in the electrostatic shielding member 1512 is sufficiently low.

A stray capacitance (equivalent capacitance) 1516 is present between the electrostatic shielding member 1512 and the object 110 to be heated. When the user touches the object 110 to be heated, leakage current flows to ground through the stray capacitance (equivalent capacitance) 1516 and the internal resistance (equivalent resistance) 1412 of the user's body by the voltage induced in the electrostatic shielding member 1512 by the induction heating coil 101. Since the voltage induced in the electrostatic shielding member 1512 is sufficiently low, the leakage current that flows to ground through the internal resistance (equivalent resistance) 1412 of the user's body is extremely small.

In other words, the internal resistance (equivalent resistance) 1515 of the electrostatic shielding member 1512, the stray capacitance (equivalent capacitance) 1516 and the internal resistance (equivalent resistance) 1412 of the user's body are connected in parallel between the electrostatic shielding member 1512 and ground. Since the impedance of the internal resistance (equivalent resistance) 1515 of the electrostatic shielding member 1512 is extremely low compared to the impedance of the stray capacitance (equivalent capacitance) 1516 and the internal resistance (equivalent resistance) 1412 of the user's body, most of the leakage current from the induction heating coil 101 flows to ground through the electrostatic shielding member 1512. Current hardly leaks to the user's body.

In the structure of the second conventional example, when the object 110 to be heated is a pan made of aluminum, copper or the like that is low in permeability and low in resistance, the number of turns of the induction heating coil 101 is increased. At this time, the voltage applied to the induction heating coil is not less than 1 kV. In the second conventional example, since the electrostatic shielding member electrically coupled to the low-potential part is present and there is hardly any potential difference between the object 110 to be heated and the electrostatic shielding member 1512 (their potentials are both close to the ground level) no leakage current is inducted in the object 110 to be heated. Therefore, it is safe even if the human body touches the object 110 to be heated.

The Official Gazette of Japanese Examined Patent Publication No. Sho 55-869 discloses an induction heating apparatus in which a fine pattern (top plate cracking sensing circuit) formed by a conductive coating is provided on the underside of the top plate. A DC current is passed through this pattern. Based on the fact that the top plate cracks and the current flowing through this pattern is interrupted, the induction heating coil is stopped.

The Official Gazettes of Japanese Unexamined Patent Publication No. Sho 62-278785 and Japanese Unexamined Patent Publication No. Sho 62-278786 disclose induction heating cookers in which the conductive fine pattern is provided on the top plate. When the induction heating coil is driven, leakage current flows through this pattern. When the leakage current becomes smaller than a reference value proportional to the output of the induction heating coil, the induction heating coil is stopped.

In the second conventional example, as long as the electrostatic shielding member sufficiently performs its function, it is safe even if the human body touches the object to be heated. However, when the electrostatic shielding member does not sufficiently perform its function for some reason, for example, because of deterioration from aging, safety is not always sufficiently ensured (there is a possibility that a leakage current of not less than a predetermined level flows through the human body when the user touches the object to be heated).

The present invention solves the above-mentioned conventional problems, and an object thereof is to provide an induction heating apparatus with high safety in which leakage current is prevented from flowing to the human body and there is no possibility of an electric shock even when the electrostatic shielding member does not sufficiently perform its function.

DISCLOSURE OF INVENTION

To solve the above-mentioned conventional problem, an induction heating apparatus of the present invention has a structure in which a sensing portion for sending the energized condition (conduction condition) of a shielding member is provided and a driving portion (inverter circuit) for driving an induction heating coil based on the sensing output of the sensing portion is controlled. This structure enables the output of the induction heating coil to be reduced or stopped by the sensing portion sensing that the conduction condition of the shielding member is deteriorated, when the shielding member cannot perform its function for some reason. An induction heating apparatus with high safety can be realized in which there is no possibility of an electric shock even when the electrostatic shielding member does not sufficiently perform its function.

The novel features of the invention are set forth with particularity in the appended claims, and the invention, both as to the construction and contents, together with further objects and features will be better understood and appreciated from the following detailed description taken in conjunction with the accompanying drawings.

Figure 1:
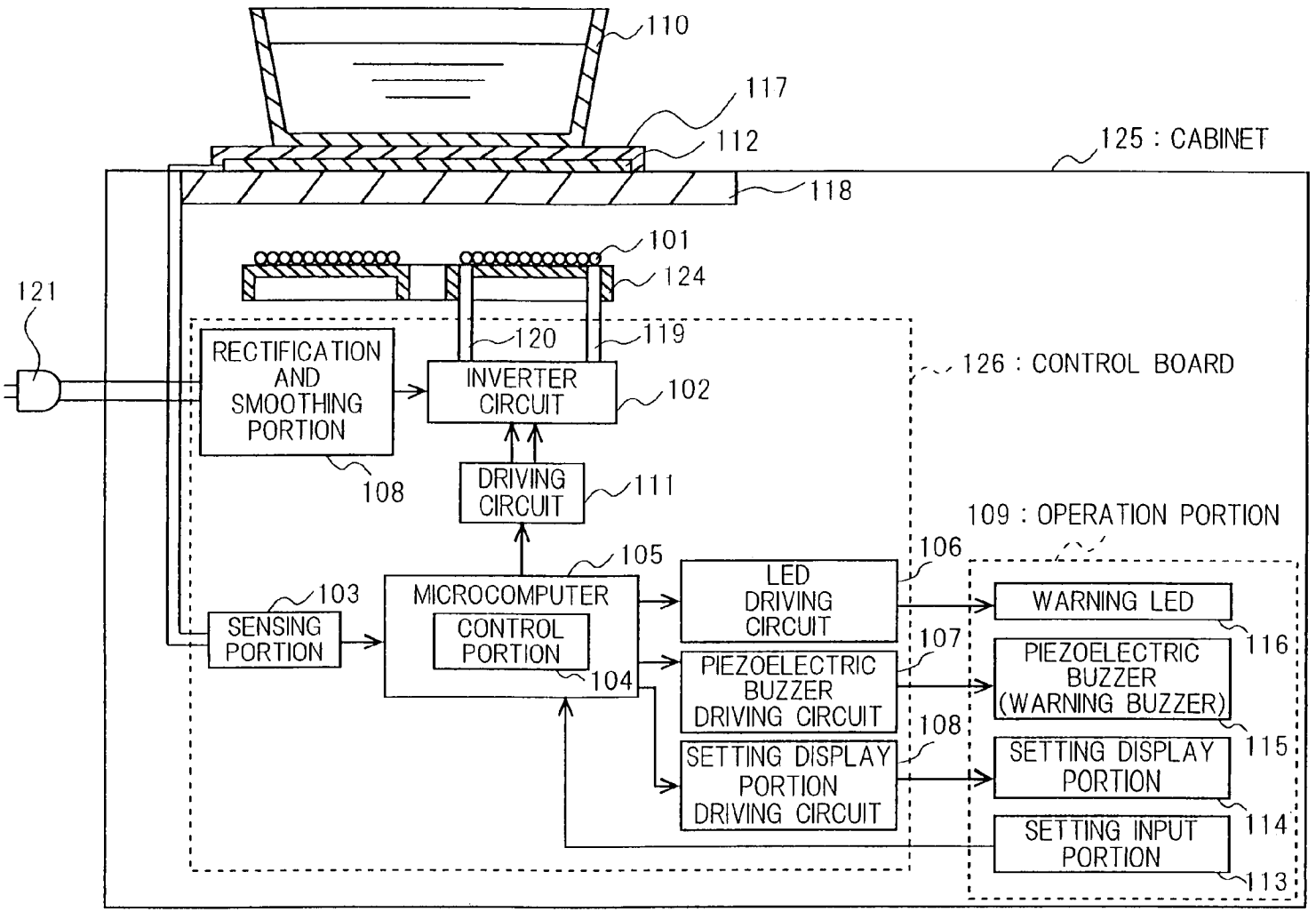
FIG. 1 is a schematic structure view of an induction heating apparatus of a first embodiment of the present invention.

It will be recognized that some or all of the Figures are schematic representations for purposes of illustration and do not necessarily depict the actual relative sizes or locations of the elements shown.

BEST MODE FOR CARRYING OUT THE INVENTION

An induction heating apparatus according to one aspect of the present invention is provided with a top plate on which an object to be heated is placed, an induction heating coil for generating a high-frequency magnetic field and heating the object to be heated, a fixing place placed on the induction heating coil, an inverter circuit for driving the induction heating coil, a conductive shielding member provided on the fixing plate, in the fixing plate or below the fixing plate and electrically connected to a low-potential part, a sensing portion for applying to the shielding member a voltage different from a voltage generated by the induction heating coil and sensing the conduction condition of the shielding member, and a control portion for controlling the inverter circuit based on the conduction condition.

An induction heating apparatus according to another aspect of the present invention is an induction heating apparatus in which an electrostatic shielding member is provided between an object to be heated and an induction heating coil wherein sensing means for sensing the conduction condition of the electrostatic shielding member is provided, and driving means for driving the induction heating coil is controlled by the sensing by the sensing means.

In the induction heating cooker described in the Official Gazette of Japanese Examined Patent Publication No. Hei 4-75634, by providing a shielding member, leakage current is prevented from flowing from the induction heating coil to a human body through the object to be heated. However, when the shielding member cannot perform its function, there is a possibility that leakage current flows from the induction heating coil to the human body through the object to be heated.

In the induction heating apparatuses described in the Official Gazettes of Japanese Unexamined Patent Publication No. Sho 62-278785, Japanese Unexamined Patent Publication No. Sho 62-278786 and Japanese Examined Patent Publication No. Sho 55-869, cracking of the top plate is sensed and the induction heating apparatus is stopped. However, the pattern provided on the top plate is fine and solely for sensing cracking of the top plate, and has hardly any shielding effect to prevent leakage current from the induction heating coil to the object to be heated. These inventions of the conventional examples have no idea of preventing leakage current. For example, when the induction heating coil outputs a high voltage to heat a low-permeability and low-resistance objects to be heated, such as aluminum, the fine conductive pattern is insufficient for preventing leakage current. Only by changing the conductive pattern provided on the top plate to a shielding member (having a size enough to produce a shielding effect), it is difficult to sense that the shielding member cannot perform its function. To provide a shielding member between the induction heating coil and the object to be heated and sense that the shielding member cannot perform its function, it is necessary to incorporate a new idea in the signal sensing method as described in the embodiments.

The present invention realizes an induction heating apparatus with high safety in which the shielding member is provided between the induction heating coil and the object to be heated to thereby prevent leakage current and when the shielding member cannot perform its function for some reason, the sensing portion senses that the conduction condition of the shielding member is deteriorated and the control portion reduces or stops the output of the induction heating coil. Even when the shielding member cannot perform its function, there is no possibility that when a person touches the object to be heated, leakage current flows to the human body to give an electric shock to the user.

The potential of a "low-potential part" may be any potential that can sufficiently reduce the leakage current flowing from the object to be heated to the human body by the induction heating coil. Preferably, the low-potential part is a portion of the potential of a ground wire or a potential close thereto.

The shielding member and the low-potential part may be connected by connecting wires (so that a DC component and an AC component flow), or may be alternatingly connected by a capacitor.

Moreover the present invention is further provided with a top plate on which an object to be heated is placed, and a fixing plate placed on the top plate and the induction heating coil, and the shielding member is provided on the fixing plate, in the fixing plate or below the fixing plate.

Since the fixing plate is placed on the induction heating coil, by providing a general-purpose fixing plate having a shielding member in an appropriate position of the induction heating apparatus according to the type of apparatus, it is unnecessary to design a shielding member for each individual type of apparatus.

That "the shielding member is provided in a fixing plate" means, for example, that the fixing plate is made of laminated glass and the shielding member is provided between the glass planes of the laminated glass. When the shielding member is provided below the fixing plate (on the side of the induction heating coil), preferably, and insulating layer covering the surface of the shielding member is provided and the insulating layer surely insulates the shielding member from the induction heating coil.

In the above-described induction heating apparatus according to another aspect of the present invention, the sensing portion determines whether the impedance of the shielding member is not more than a predetermined threshold value or not, whether the voltage between predetermined terminals of the shielding member is not more than a predetermined threshold value or not, or whether a current flowing through the shielding member is not less than a predetermined threshold value or not, and the control portion reduces or stops the output of the induction heating coil when the impedance of the shielding member is higher than the predetermined threshold value, when the voltage between the predetermined terminals of the shielding member is higher than the predetermined threshold value or when the current flowing through the shielding member is smaller than the predetermined threshold value.

According to this structure, when the function of the shielding member is degraded for some reason (when the conduction condition of the shielding member is deteriorated), the sensing portion senses the degree of the function degradation by applying power to the shielding member, and the induction heating apparatus can reduce or stop the output of the induction heating coil when a predetermined reference value (threshold value) is exceeded. Even when the shielding member cannot perform its function, there is no possibility that when a person touches the object to be heated, leakage current flows to the human body to give an electric shock to the user.

In the above-described induction heating apparatus according to another aspect of the present invention, when the induction heating coil is stopped, the sensing portion applies the voltage different from the voltage generated by the induction heating coil to the shielding member and senses the conduction condition of the shielding member, and when the induction heating coil is energized, the sensing portion senses the conduction condition of the shielding member based on a noise induced in the shielding member by the induction heating coil.

By applying the voltage different from the voltage generated by the induction heating coil to the shielding member, it can be sensed that the conduction of the shielding member is deteriorated when the induction heating coil is not operating. Since, for example, the induction heating coil can be made not to operate from the beginning when the conduction of the shielding member is deteriorated (This does not mean that the induction heating coil is operated once and only after the induction heating coil is operated, it is sensed that the conduction condition of the shielding member is deteriorated and the induction heating coil is stopped), an induction heating apparatus with high safety can be realized.

When a shielding member having a large area is provided between the induction heating coil and the object to be heated, a large leakage current flows to the shielding member when the induction heating coil is operating. There are cases where the sensing portion cannot correctly sense the conduction condition of the shielding member because the leakage current is extremely large and disturbs the sensing. Even in such a case, according to the present invention, the conduction condition of the shielding member is sensed when the induction heating coil is not operating and the sensing portion outputs a correct sensing result.

The "voltage different from the voltage generated by the induction heating coil" does not include the leakage voltage of the induction heating coil.

In the above-described induction heating apparatus according to another aspect of the present invention, the function of the control portion is executed by software processing by a microcomputer, and in a case where the sensing portion senses that the conduction condition of the shielding member is deteriorated when the induction heating coil is energized, the microcomputer stops the induction heating coil by interruption processing.

The software processing by the microcomputer is executed every normal processing cycle period. Therefore, at worst, the response of the microcomputer is delayed by the processing cycle period. When the conduction condition of the shielding member is deteriorated, to prevent leakage current from flowing from the induction heating coil to the human body, it is important that the safety function (to reduce or stop the output of the induction heating coil) work quickly. By the present invention, the safety function can be exercised without any delay caused by the interruption processing.

In the above-described induction heating apparatus according to another aspect of the present invention, the sensing portion senses the conduction condition of the shielding member at least under a condition where the induction heating coil is not energized.

By this, the energized condition (conduction condition) of the shielding member can be confirmed even when induction heating is not used, and high safety of the induction heating apparatus can be ensured. There are cases where the sensing portion cannot correctly sense the conduction condition of the shielding member because the leakage current is extremely large and disturbs the sensing. Even in such a case, according to the present invention, the conduction condition of the shielding member is sensed when the induction heating coil is not operating, and the sensing portion outputs a correct sensing result.

In such a case, preferably, the sensing portion senses the conduction condition of the shielding member by applying a voltage different from the voltage generated by the induction heating coil to the shielding member when the induction heating coil is not operating, and the sensing portion does not sense the conduction condition of the shielding member referring to the voltage different from the voltage generated by the induction heating coil when the induction heating coil is operating. Further preferably, the conduction condition of the shielding member is sensed by a different method when the induction heating coil is operating.

In the above-described induction heating apparatus according to another aspect of the present invention, under a condition where the induction heating coil is energized, the sensing of the conduction condition of the shielding member by the sensing portion is substantially inhibited or a sensing result of the sensing portion is invalidated.

There are cases where the sensing portion cannot correctly sense the conduction condition of the shielding member because the leakage current is extremely large disturbs the sensing. In the present invention, when the induction heating coil is not operating, the sensing portion correctly senses the conduction condition of the shielding member by applying a voltage different from the voltage generated by the induction heating coil to the shielding member, and when the induction heating coil is operating, the sensing portion substantially does not perform the sensing of the conduction condition of the shielding member referring to the voltage different from the voltage generated by the induction heating coil or the sensing result is not used. The malfunctioning of the induction heating apparatus based on an erroneous sensing result can be prevented. The safety function can be appropriately exercised referring to a correct sensing result obtained when the induction heating coil is not operating.

When the induction heating coil is operating, the sensing portion may sense the conduction condition of the shielding member by a different method (a method other than the method in which the conduction condition of the shielding member is sensed referring to the voltage different from the voltage generated by the induction heating coil).

In the above-described induction heating apparatus according to another aspect of the present invention, the sensing portion feeds a direct current to the shielding member and senses the conduction condition of the shielding member. By this, the sensing portion can easily and surely sense the conduction condition (energized condition) of the shielding member.

In the above-described induction heating apparatus according to another aspect of the present invention, the sensing portion senses the conduction condition of the shielding member every predetermined time while the induction heating coil is energized. By reducing the power consumption when the sensing portion does not perform sensing, the power required for the sensing portion to sense the conduction condition of the shielding member is effectually reduced, so that useless power consumption can be eliminated. In particular, the standby power when the induction heating apparatus is not used can be reduced.

When the induction heating coil is energized, there are cases where it is preferable that the sensing portion quickly sense the conduction condition of the shielding member. The following may be performed: when the induction heating coil is energized, the sensing portion checks the conduction condition of the shielding member in real time (for example, by interruption processing), and when the induction heating coil is not energized, the sensing portion checks the conduction condition of the shielding member every predetermined time.

The above-described induction heating apparatus according to another aspect of the present invention is further provided with a display portion and/or a notification portion, and when the shielding member is nonconducting from a predetermined threshold value, the display portion indicates an abnormal condition and/or the notification portion notifies the abnormal condition. In the above-described induction heating apparatus according to another aspect of the present invention, a display portion and/or a notification portion is provided and the display portion indicates an abnormal condition and/or the notification portion notifies the abnormal condition when a value sensed by the sensing means becomes not more than a reference value.

By this, the user can be accurately notified of the abnormal condition. The user can properly repair the induction heating apparatus.

The "display portion" is a portion that visually indicates the abnormal condition (condition where the conduction of the shielding member is deteriorated). The display portion is, for example, a visible LED or a liquid crystal display.

The "notification portion" is a portion that auditorily indicates the abnormal condition. The notification portion is, for example, a piezoelectric buzzer or a speaker for voice guidance.

In the above-described induction heating apparatus according to another aspect of the present invention, the shielding member and the sensing portion are connected by at least two connecting wires, and the sensing portion senses the conduction condition of a path including at least two of the connecting wires and at least part of the shielding member. In the above-described induction heating apparatus according to another aspect of the present invention, the electrostatic shielding member has at least two connection portions, and sensing means is provided for applying power between the connection portions and sensing its conduction condition.

The sensing portion can surely sense the conduction condition of the shielding member by sensing the conduction condition of the path including the two connecting wires and at least part of the shielding member. With the structure in which the shielding member and the sensing portion are connected by two or more connecting wires, even when one connecting wire is disconnected and the sensing portion senses that the conduction condition between the shielding member and the low-potential part is deteriorated, substantial conduction between the shielding member and the low-potential part can be ensured. Also in this case, hardly any leakage current flows from the induction heating coil to the user through the object to be heated.

In the above-described induction heating apparatus according to another aspect of the present invention, the shielding member has a shape in which a closed loop including a central axis of the induction heating coil is absent thereon. By this, it can be prevented that an eddy current induced by the induction heating coil flows to the shielding member and the shielding member uselessly consumes energy. By reducing the heat generation of the shielding member, the life of the shielding member can be prolonged.

In the above-described induction heating apparatus according to another aspect of the present invention, the shielding member has a substantially arc shape that is coaxial with the induction heating coil and substantially covers the induction heating coil. In the above-described induction heating apparatus according to another aspect of the present invention, the electrostatic shielding member has a substantially arc shape. The shielding member does not uselessly consume energy and can uniformly apply shielding to the substantially circular induction heating coil.

The above-described induction heating apparatus according to another aspect of the present invention is an induction heating apparatus in which a different voltage is applied to the induction heating coil according to when the object to be heated is magnetic, or non-magnetic and high in resistance and when the object to be heated is non-magnetic and low in resistance, and the control portion controls the inverter circuit based on the conduction condition only when the object to be heated is non-magnetic and low in resistance.

In the induction heating apparatus, a higher voltage is applied to the induction heating coil when the object to be heated is non-magnetic and low in resistance than when it is magnetic, or non-magnetic and high in resistance. It is particularly a problem that leakage current flows from the induction heating coil to the user through the object to be heated when the object to be heated is non-magnetic and low in resistance. In the present structure, only when the object to be heated is non-magnetic and low in resistance and the conduction of the electrostatic shielding member is deteriorated, for example, the output of the induction heating coil is reduced or stopped. The control portion controls the inverter circuit based on the conduction condition of the shielding member within the minimum necessary range. It does not readily occur that the sensing portion makes a mis-sensing and inconveniences the user when the shielding member has an excellent conduction condition. The present invention realizes an induction heating apparatus that appropriately operates the safety function.

The above-described induction heating apparatus according to another aspect of the present invention is further provided with a display portion and/or a notification portion, and the display portion indicates and/or the notification portion notifies that the induction heating apparatus cannot be used only when the object to be heated is non-magnetic and low in resistance in a case where the shielding member is nonconducting from a predetermined threshold value.

By this, the user can be accurately notified that the induction heating apparatus cannot be used only when the object to be heated is non-magnetic and low in resistance. The user can properly use and repair the induction heating apparatus.

Hereinafter, embodiments of the present invention will be described with reference to the drawings.

<<First Embodiment>>

An induction heating apparatus of a first embodiment of the present invention will be described referring to FIGS. 1 to 4. FIG. 1 is a view showing a schematic structure of the induction heating apparatus of the first embodiment, and FIG. 3 is a view showing a circuit structure of the induction heating apparatus of the first embodiment. The induction heating apparatus of the first embodiment is capable of heating high-permeability (magnetic) objects to be heated, such as iron (or low-permeability and high-resistance objects to be heated, such as 18-8 stainless steel) and low-permeability (non-magnetic) and low-resistance objects to be heated, such as aluminum or copper.

In FIGS. 1 and 3, reference numeral 110 represents an object to be heated (load which is a metal vessel such as a pan or a frying pan), reference numeral 125 represents a cabinet, reference numeral 118 represents a top plate disposed on the top surface of the cabinet and on which the object 110 to be heated is placed, reference numeral 112 represents an electrostatic shielding member provided on the top plate, reference numeral 117 represents an insulating layer covering the electrostatic shielding member 112, reference numeral 101 represents an induction heating coil for generating a high-frequency magnetic field and heating the induction heating coil 101, reference numeral 124 represents an induction heating coil holding member on the top surface of which the induction heating coil 101 is placed, reference numeral 127 represents a commercial AC source, reference numeral 121 represents a plug to which the commercial AC source is inputted, reference numeral 126 represents a control board, and reference numeral 109 represents an operation portion.

The control board 126 has a rectification and smoothing portion 108 that rectifies the commercial AC source, an inverter circuit 102 that converts the power source rectified by the rectification and smoothing portion 108 to a high-frequency power and supplies a high-frequency current to the induction heating coil 101, a driving circuit 111 for the inverter circuit 102, a sensing portion 103, a microcomputer 105, an LED driving circuit 106, a piezoelectric buzzer driving circuit (warning buzzer driving circuit) 107, and a setting display portion driving circuit 108. The blocks on the control board 126 have a common ground wire (ground pattern).

Reference numerals 119 and 120 represent two connecting wires that connect the inverter circuit 102 and the induction heating coil 101. Reference numerals 122 and 123 represent two connecting wires that connect the electrostatic shielding member 112 and the control board 126.

The connecting wire 119 connects the outer end of the induction heating coil 101 to one end of a resonant capacitor 102*g*, and the connecting wire 120 connects the inner end of the induction heating coil 101 to the emitter of a switching element 102*c* and the collector of a switching element 102*d*. The potential of the outer end of the helically wound induction heating coil 101 is lower than the potential of the inner end thereof.

The microcomputer 105 has a control portion 104. The function of the control portion 104 is processed by software.

The operation portion 109 has a setting input portion 113, a setting display portion 114, a red warning LED 116, and a piezoelectric buzzer (warning buzzer) 115.

The setting input portion 113 has a plurality of input key switches that the user operates to input a heating output setting instruction, or a heating start or stop instruction. The instruction inputted by the setting input portion 113 is inputted to the control portion 104.

The control portion 104 drives the driving circuit 111, the LED driving circuit 106, the piezoelectric buzzer driving circuit 107 and the setting display portion driving circuit 108. The driving circuit 111 drives the switching elements 102*c* and 102*d* of the inverter circuit 102. The setting display portion driving circuit 108 drives the setting display portion 114 (having a plurality of visible LEDs). The setting display portion 114 displays to the user the contents of the heating output setting set through the setting input portion 113, and the like.

The control portion 104 controls the output of the inverter circuit 102 through the driving circuit 111 in response to various instructions inputted from the setting input portion 113, the output signal (signal responsive to the source current of the inverter circuit 102) of an output sensing portion (not shown) and the output signal of the sensing portion 103. The heating output is varied by controlling the driving frequencies of the switching elements. When the object 110 to be heated is made of a low-permeability (non-magnetic) and low-resistance material such as aluminum or copper, the induction heating coil 101 is driven at a high frequency and a high voltage compared to when the object 110 to be heated is made of a high-permeability (magnetic) material such as iron (or when it is made of a low-permeability and high-resistance material such as 18-8 stainless steel). When the object 110 to be heated is made of a low-permeability and low-resistance material, the number of turns of the induction heating coil may be increased by switching the contact of a relay (not shown).

The commercial source 127 is inputted to the rectification and smoothing portion 108. The rectification and smoothing portion 108 has a full-wave rectifier 108*a* comprising a bridge diode and a first smoothing capacitor 108*b* connected between the DC output ends.

The input terminal of the inverter circuit 102 is connected to both ends (the output terminals of the rectification and smoothing portion 108) of the first smoothing capacitor 108*b*. The induction heating coil 101 is connected to the output terminal of the inverter circuit 102. The inverter circuit 102 and the induction heating coil 101 constitute a high-frequency inverter. A series-connected member (hereinafter referred to as "series-connected member 102*c* and 102*d*") of the first switching element 102*c* (in the present embodiment, an IGBT (insulated gate bipolar transistor)) and the second switching element 102*d* (in this embodiment, an IGBT) is provided in the inverter circuit 102. A first diode 102*e* is connected to the first switching element 102*c* in the opposite direction and in parallel, and a second diode 102*f* is connected to the second switching element 102*d* in the opposite direction and in parallel. A second smoothing capacitor 102*b* is connected to both ends of the series-connected member 102*c* and 102*d*.

A choke coil 102*a* is connected between the point of connection of the first switching element 102*c* and the second switching element 102*d* (hereinafter referred to as "the middle point of the series-connected member 102*c* and 102*d*") and the positive end of the full-wave rectifier 108*a*. The low-potential terminal of the series-connected member 102*c* and 102*d* is connected to the negative terminal (in the embodiment, the ground terminal) of the full-wave rectifier 108*a*. A series-connected member of the induction heating coil 101 and the resonant capacitor 102*g* is connected between the middle point of the series-connected member 102*c* and 102*d* and the negative terminal of the full-wave rectifier 108*a*.

The control portion 104 drives the first switching element 102*c* and the second switching element 102*d* through the driving circuit 111.

The operation of the induction heating cooker structured as described above will be described. The full-wave rectifier 108*a* rectifies the commercial AC source 127. The first smoothing capacitor 108*b* supplies power to the high-frequency inverter comprising the inverter circuit 102 and the induction heating coil 101.

When the second switching element 102*d* is ON, a resonance current flows through a closed circuit including the second switching element 102*d* (or the second diode 102*f*), the induction heating coil 101 and the resonant capacitor 102*g*, and energy is stored in the choke coil 102*a*. The stored energy is, when the second switching element 102*d* is turned off, released to the second smoothing capacitor 102*b* through the first diode 102*e*.

After the second switching element 102*d* is turned off, the first switching element 102*c* is turned on, and current flows through the first switching element 102*c* and the first diode 102*e*. A resonance current flows through a closed circuit including the first switching element 102*c* (or the first diode 102*e*), the induction heating coil 101, the resonant capacitor 102*g* and the second smoothing capacitor 102*b*.

The driving frequencies of the first switching element 102*c* and the second switching element 102*d* are varied in the vicinity of approximately 20 kHz. When an object to be heated that is magnetic (typically, an iron cooking vessel) is heated, a high-frequency current of approximately 20 kHz flows through the induction heating coil 101. Each driving time ratio of the first switching element 102*c* and the second switching element 102*d* is varied in the vicinity of approximately ½. The impedances of the induction heating coil 101 and the resonant capacitor 102*g* are set so that when the object 110 to be heated (cooking pan) made of a specified material (for example, a high-conductivity non-magnetic material such as aluminum) and having a standard size (for example, not less than the diameter of the induction heating coil) is placed in a specified position on the top plate (for example, a position indicated as the heated part), the resonance frequencies thereof are approximately three times the driving frequencies. Therefore, in this case, the resonance frequencies are set so as to be approximately 60 kHz.

Since a high-frequency current of approximately 60 kHz which is higher than normal flows through the induction heating coil 101 when the object 110 to be heated is made of aluminum, the cooking pan can be efficiently heated. The high-frequency inverter of the present embodiment is high in heating efficiency because the regenerated current flowing through the first diode 102*e* and the second diode 102*f* does not flow through the first smoothing capacitor 108*b* but is supplied to the second smoothing capacitor 102*b*.

The envelope of the high-frequency current supplied to the induction heating coil 101 is better smoothed by the second smoothing capacitor 102*b* than that of the conventional induction heating apparatus. This reduces the commercial frequency component of a current IL flowing through the induction heating coil 101 which is a cause of the generation of vibrating noise from the pan 110 or the like at the time of heating.

The electrostatic shielding member 112 shields the object 110 to be heated from the induction heating coil 101 to thereby prevent the leakage current induced by the induction heating coil 101 from flowing through the user's body.

Figure 2:
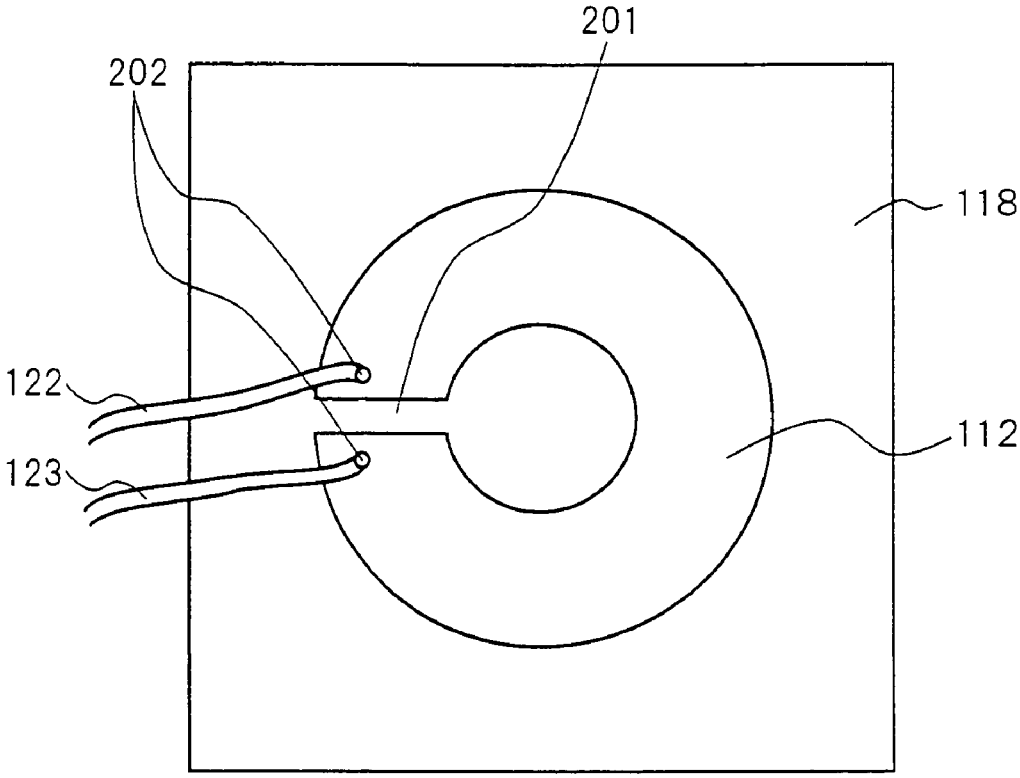
FIG. 2 is a view showing an example of a pattern of an electrostatic shielding member of the induction heating apparatus of the first embodiment of the present invention.
Figure 3:
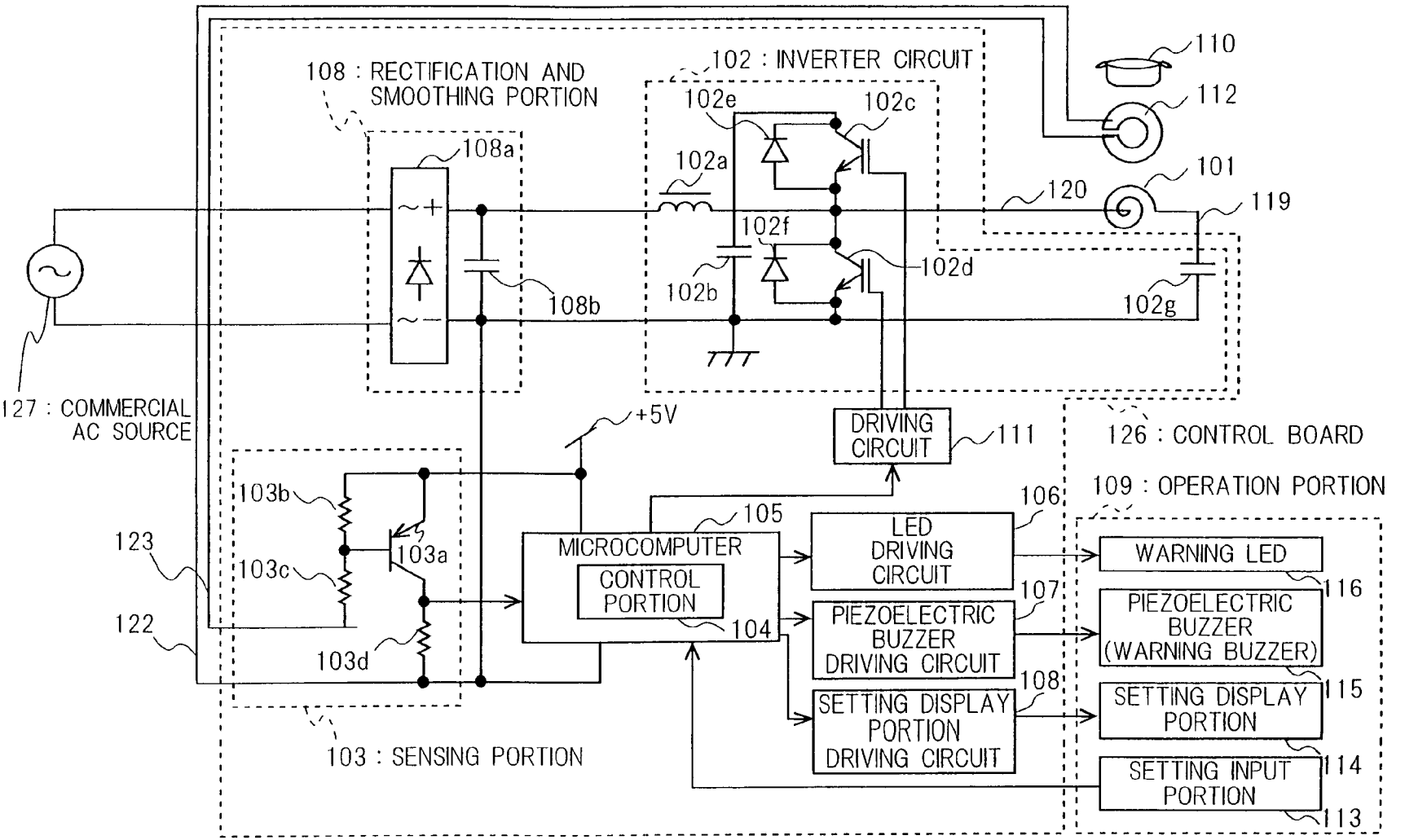
FIG. 3 is a block diagram showing the structure of the induction heating apparatus of the first embodiment of the present invention.

FIG. 2 is a view showing the pattern of the electrostatic shielding member 118 formed on the top plate 118 of the induction heating apparatus of the first embodiment. For ease of understanding, FIG. 2 shows the pattern of the electrostatic shielding member 112 excluding the insulating layer 117. The electrostatic shielding member 112 is formed by applying a conductive carbon coating to the top surface of the top plate 118 and baking it. The electrostatic shielding member 112 is made of an arbitrary conductive material. For example, aluminum may be evaporated onto the top surface of the top plate 118. The electrostatic shielding member 112 has a substantially arc shape that has an outer diameter substantially similar to that of the induction heating coil 101, is split by a slit 201, is coaxial with the induction heating coil 101 and substantially covers the induction heating coil 101. The electrostatic shielding member 112 has a shape in which a closed loop including the central axis of the induction heating coil 101 is absent thereon. The electrostatic shielding member 112 has two connection portions 202 on both ends of the pattern. The connecting wires 122 and 123 are connected to the connection portions 202, respectively. The other end of the connecting wire 122 is connected to the ground of the sensing portion 103. The other end of the connecting wire 123 is connected to the input terminal (one end of a resistor 103*c*) of the sensing portion 103.

The sensing portion 103 senses the conduction condition of the electrostatic shielding member 112 and the control board 126. The sensing portion 103 has a transistor 103*a* and resistors 103*b*, 103*c* and 103*d*. The sensing portion 103 feeds a DC current (a voltage different from the voltage generated by the induction heating coil 101) to the electrostatic shielding member 112 through the connecting wires 122 and 123, and senses the conduction condition thereof.

The sensing portion 103 feeds a current to the low-potential part (in the embodiment, ground) through the electrostatic shielding member 112.

Normally, the conduction condition of the electrostatic shielding member 112 and the control board 126 is excellent. In this case, a DC current flows from a DC source voltage of +5 V to the ground wire through the resistor 103*b* and the transistor 103*a*, the resistor 103*c*, the connecting wire 123, the electrostatic shielding member 112 and the connecting wire 123. By the base current of the PNP transistor 103*a* flowing, the transistor 103*a* is brought into conduction. By a current flowing between the emitter and collector of the transistor 103*a*, the collector potential (the voltage across the resistor 103*d*) of the transistor 103*a* is approximately +5 V.

For example, when one end of the connecting wire 122 is disconnected (the conduction condition of the electrostatic shielding member 112 and the control board 126 is deteriorated), no DC current flows from the DC source voltage of +5 V to the ground wire through the resistor 103*b* and the transistor 103*a*, the resistor 103*c*, the connecting wire 123, the electrostatic shielding member 112 and the connecting wire 123. By the base current of the PNP transistor 103*a* not flowing, the transistor 103*a* is shut off. By no current flowing between the emitter and collector of the transistor 103*a*, the collector potential (the voltage across the resistor 103*d*) of the transistor 103*a* is 0 V.

The control portion 104 (microcomputer 105) inputs the collector potential of the transistor 103*a*. When the conduction condition of the electrostatic shielding member 112 and the control board 126 is deteriorated, the control portion 104 stops the induction heating coil 101, turns on the red warning LED 116 through the LED driving circuit 106, and sounds the piezoelectric buzzer 115 through the piezoelectric buzzer driving circuit 107. The user can easily recognize that something is wrong with the electrostatic shielding member 112.

Instead of the warning LED 116, a liquid crystal display may be used. Instead of the piezoelectric buzzer 115, a speaker for voice guidance may be used.

Figure 4:
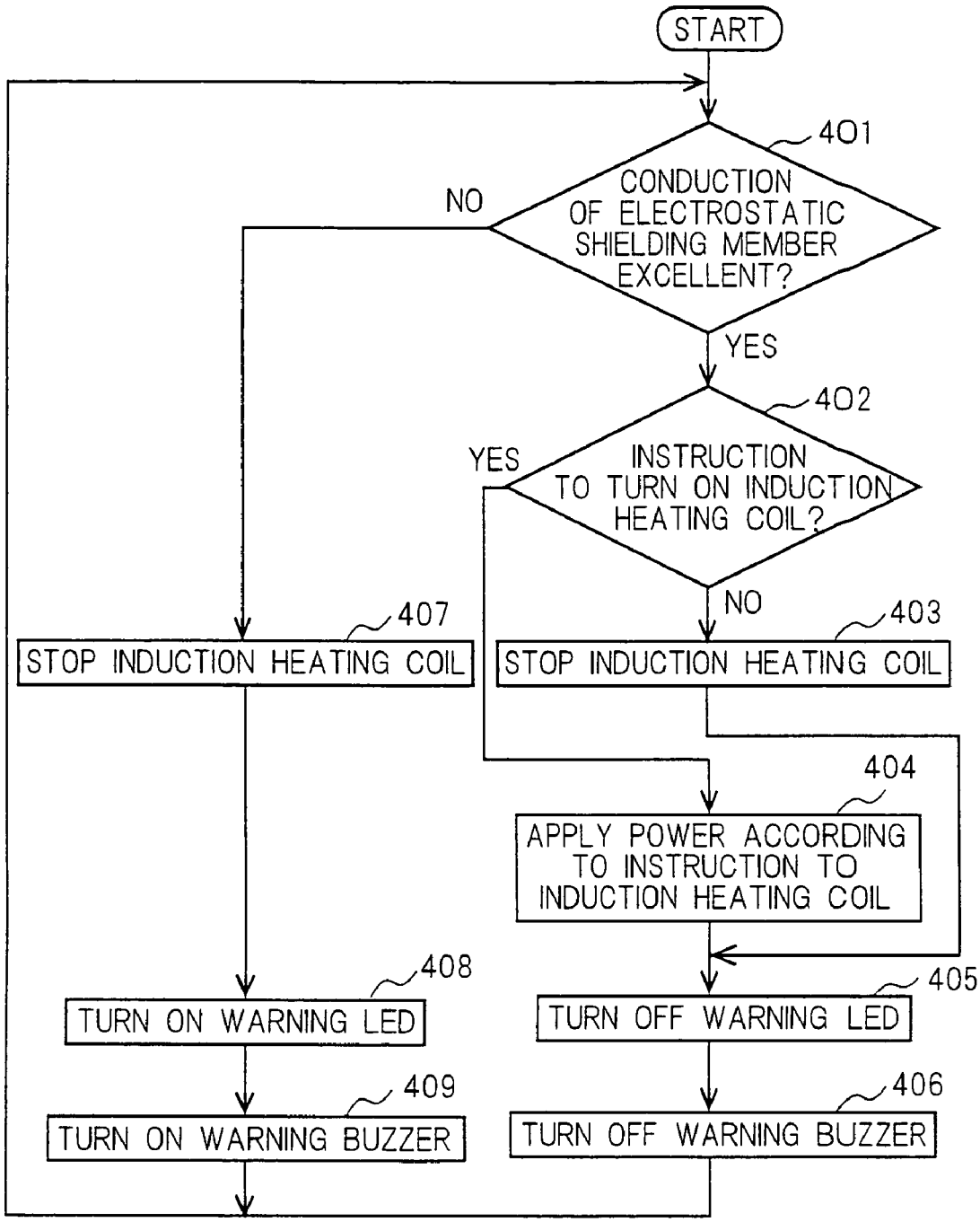
FIG. 4 is a flowchart showing the control method of the induction heating apparatus of the first embodiment of the present invention.

FIG. 4 is a flowchart showing the control method of the induction heating apparatus of the first embodiment. FIG. 4 has steps 401 to 409. First, the control portion 104 checks whether the conduction condition of the electrostatic shielding member 112 is excellent or not (whether the collector potential of the transistor 103*a* is +5 V or 0 V) (step 401). When the conduction condition is excellent, the process proceeds to step 402, and when the conduction condition is poor, the process proceeds to step 407.

At step 402, the control portion 104 checks whether an instruction to turn on the induction heating coil 101 is provided or not. When the instruction to turn on the induction heating coil 101 is provided, the process proceeds to step 404. When the instruction to turn on the induction heating coil 101 is not provided, the process proceeds to step 403, and the inverter circuit 102 is controlled to thereby stop the induction heating coil 101. The process proceeds to step 405.

At step 404 (The instruction to turn on the induction heating coil is provided), the control portion 104 controls the inverter circuit 102 and applies the power according to the instruction to the induction heating coil 101. At step 405, the warning LED 116 is turned off. Then, the warning buzzer (piezoelectric buzzer) 115 is turned off (step 406). The process returns to step 401, and the above-described processing is repeated.

At step 407 (the conduction condition is poor), the control portion 104 controls the inverter circuit 102 and stops the induction heating coil 101. Then, at step 408, the warning LED 116 is turned on. Then, the warning buzzer (piezoelectric buzzer) 115 is turned on (step 409). The process returns to step 401, and the above-described processing is repeated.

In the first embodiment, in a case where the stray capacitance (equivalent capacitance) 1514 between the electrostatic shielding member 112 and the induction heating coil 101 is large, when the induction heating coil 101 is energized, there are cases where a large noise is superposed on the input voltage of the sensing portion 103 and the sensing portion 103 cannot correctly sense the conduction condition of the electrostatic shielding member 112. In such a case, only when the induction heating coil 101 is not energized, the sensing portion 103 senses the conduction condition of the electrostatic shielding member 112. That is, in a case where the conduction condition of the electrostatic shielding member 112 is poor when an instruction to turn the induction heating coil 101 from OFF to ON is inputted, the control portion 104 does not bring the induction heating coil 101 into conduction. This enables the sensing portion 103 to correctly sense the conduction condition of the electrostatic shielding member 112. Once the induction heating coil 101 is brought into operating state (energized state), the sensing portion 103 does not check the conduction condition of the electrostatic shielding member 112.

When the inverter circuit 102 (driving portion) is driven and a high-frequency current is passed through the induction heating coil 101, an eddy current occurs in the object 110 to be heated such as a pan because of the generated high-frequency magnetic field. The object 110 to be heated generates heat, whereby cooking is performed. When the object 110 to be heated is a high-permeability pan such as iron, the object 110 to be heated can be heated by applying a low voltage to the induction heating coil 101 at a comparatively low frequency. However, to heat a low-permeability pan such as aluminum or copper, it is necessary to apply a high voltage to the induction heating coil 101 at a high frequency. Consequently, for example, it is necessary that the number of turns of the induction heating coil 101 be large.

In FIG. 1, the induction heating coil 101 is shown as a single-layer coil of approximately 12 turns. The induction heating coil 101 may be a multiple-layer coil, and may be, for example, a multiple-layer coil whose total number of turns is approximately 30 to 60. The voltage across the induction heating coil 101 of such number of turns is a high voltage exceeding 1 kV. In the induction heating apparatus of the first conventional example, when the user touches the object 110 to be heated, there is a possibility that leakage current flows to the human body through the object 110 to be heated because of the equivalent capacitance 1411 between the induction heating coil 101 and the object 110 to be heated. Therefore, according to the present embodiment, the electrostatic shielding member 112 is provided, and this is connected to the low-potential part to thereby reduce the potential of the object 110 to be heated so that no leakage current is inducted.

The insulating layer 117 is provided on the top of the electrostatic shielding member 112. This prevents the leakage current induced in the electrostatic shielding member 112 from leaking to the object 110 to be heated and prevents the electrostatic shielding member 112 from being damaged by a movement of the object 110 to be heated, or the like.

The present embodiment is characterized in that the conduction condition of the electrostatic shielding member 112 is sensed. The sensing portion 103 senses the conduction condition of the electrostatic shielding member 112 to thereby sense whether the electrostatic shielding member 112 is in the normal condition or not. For example, when an abnormal condition occurs such that current is difficult to flow through the electrostatic shielding member 112 or the connecting wires 122 and 123 or does not flow therethrough because of a break due to a thermal stimulus such as a cold heat cycle or deterioration from aging such as corrosion, this is sensed and transmitted to the control portion 104 (a part of the driving portion). The control portion 104 reduces or stops the output of the inverter circuit 102 (another part of the driving portion). In this manner, even when the current leakage prevention function is lost because of an abnormality of the electrostatic shielding member 112, the leakage current can be prevented from flowing to a person through the object 110 to be heated, so that safety can be ensured.

When the abnormal condition is clear such as a break, it is easy to determine whether the conduction condition is excellent or not. There are cases where the conduction condition gradually deteriorates such as the thermal stimulus and deterioration from aging. In this case, preferably, the relationship between the conduction condition and the leakage current to the object 110 to be heated is previously obtained through an experiment or the like, and a reference value of the conduction condition that can ensure safety is determined. When the conduction condition becomes not more than the reference value, the output of the inverter circuit 102 is reduced or stopped.

The size of the pattern of the electrostatic shielding member 112 is substantially similar to that of induction heating coil 101, and the shape of the electrostatic shielding member 112 is a substantially arc shape split by the slit 201. The lead wires 122 and 123 are connected to the connection portions 202 at both ends of this pattern, respectively. By this, electrostatic shielding can be uniformly applied to the substantially circular induction heating coil 101, and a stable shielding effect can be produced for the electric field generated from the induction heating coil 101. Since the sensing portion 103 senses the conduction condition between the connection portions 202, even if the electrostatic shielding member itself breaks due to damage or the like, the abnormal condition can be accurately detected.

When the power switch (not shown) of the main unit is turned on, the sensing portion 103 feeds current to the electrostatic shielding member 112 at all times and senses the conduction condition thereof even under a condition where the induction heating coil 101 is not energized. In a case where the sensing portion 17 senses an abnormal condition under a condition where the induction heating coil 101 is not energized, the output of the inverter circuit 102 can be stopped before the user operates heating, so that higher safety can be maintained. When the sensing portion 103 can sense the conduction condition of the electrostatic shielding member 112 even if there is leakage current from the induction heating coil 101, the sensing portion 103 operates also while the induction heating coil 101 is energized.

As described above, according to the present embodiment, the electrostatic shielding member is provided, the conduction condition (energized condition) of the electrostatic shielding member is checked at all times (even when the induction heating coil is stopped), and when the conduction condition is not more than the reference value, the control portion controls the inverter circuit to reduce or stop the output thereof. By this, the leakage current never flows to the human body through the object to be heated, so that safety is ensured.

The induction heating apparatus of the first embodiment has a display portion (warning LED 116) for indicating that the conduction condition of the electrostatic shielding member 112 is deteriorated, and a notification portion (piezoelectric buzzer (warning buzzer) 115) for notifying the deterioration. The induction heating apparatus may have only one of the display portion and the notification portion.

The induction heating apparatus has a structure in which the potential of the outer end of the helically wound induction heating coil 101 is lower than the potential of the inner end thereof. When the object 110 to be heated with a large bottom surface (for example, a pan having a large diameter) is heated, a stray capacitance (equivalent capacitance) that connects the induction heating coil 101 and the object 110 to be heated is caused by way of the outer side of the shielding member 112. In the present structure, since the potential of the outer end of the induction heating coil 101 is low, the voltage applied to the stray capacitance (equivalent capacitance) connecting the induction heating coil 101 and the object 110 to be heated is extremely low. Hardly any leakage current flows from the induction heating coil 101 to the user through the object 110 to be heated.

<<Second Embodiment>>

Figure 5:
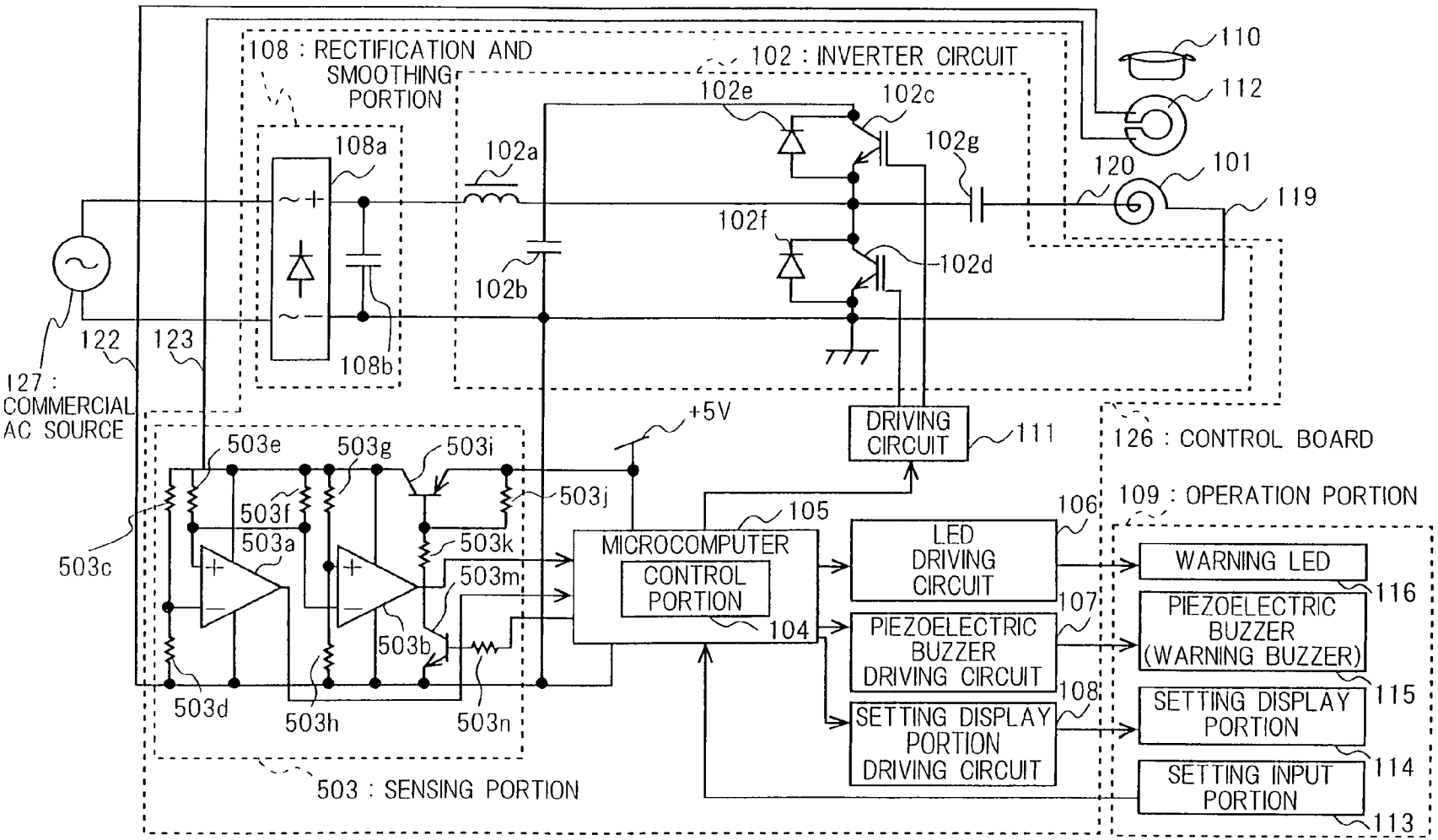
FIG. 5 is a block diagram showing the structure of an induction heating apparatus of a second embodiment of the present invention.

An induction heating apparatus of a second embodiment of the present invention will be described referring to FIGS. 5 and 6. The schematic structure of the induction heating apparatus of the second embodiment is the same as that of the first embodiment (FIG. 1). FIG. 5 is a view showing a circuit structure of the induction heating apparatus of the second embodiment. The induction heating apparatus of the second embodiment is capable of heating high-permeability (magnetic) objects to be heated, such as iron (or low-permeability and high-resistance objects to be heated, such as 18-8 stainless steel) and low-permeability (non-magnetic) and low-resistance objects to be heated, such as aluminum or copper. The induction heating apparatus of the second embodiment is different from that of the first embodiment in the circuit structure of a sensing portion 503 and the control method associated with the sensing of the conduction condition of the electrostatic shielding member 112. One end of the induction heating coil 101 is directly connected to the ground wire of the inverter circuit 102 (the resonant capacitor 102*g* is disposed between the emitter of the first switching element 102*c* and the collector of the second switching element 102*d*, and the induction heating coil 101). Except these, the second embodiment is the same as the first embodiment. Since the basic structure of the present embodiment is the same as that of the first embodiment, different points will be mainly described. The same functions as those of the first embodiment are denoted by the same reference numerals and descriptions thereof are omitted.

The sensing portion 503 has comparators 503*a* and 503*b*, resistors 503*c*, 503*d*, 503*e*, 503*f*, 503*g*, 503*h*, 503*j*, 503*k* and 503*n*, and transistors 503*i* and 503*m*. The transistors 503*i* and 503*m* and the resistors 503*j*, 503*k* and 503*n* constitute a power switching circuit that supplies power to the sensing portion 503. The control portion 104 controls ON/OFF of the power switching circuit (a voltage of +5 V is inputted to the base of the transistor 503 through the resistor 503*n* to thereby turn on the power switching circuit, and a voltage of 0 V is inputted to turn off the power switching circuit. The control portion 104 turns on the power switching circuit once every time T0 (for example, T0=10 seconds). When the power switching circuit is OFF, the sensing portion 503 consumes hardly any power. The sensing portion 503 senses the conduction condition of the electrostatic shielding member 112 only when the power switching circuit is ON.

The operation of the sensing portion 503 when the power switching circuit is ON will be described. A DC voltage of +5 V (source voltage different from the voltage generated by the induction heating coil 101) is applied to the electrostatic shielding member 112 through the resistors 503*f* and 503*e*. The potential of the connecting point of the resistors 503*f* and 503*e* is inputted to the non-inverting input terminal of the comparator 503*a* and the inverting input terminal of the comparator 503*b*. A first reference voltage Vref1 is inputted to the inverting input terminal of the comparator 503*a*, and a second reference voltage Vref2 is inputted to the non-inverting input terminal of the comparator 503*b*. In the second embodiment, the first reference voltage Vref1<the second reference voltage Vref2. The control portion 104 inputs the output signals of the comparators 503*a* and 503*b*.

When the induction heating coil 101 is stopped, the control portion 104 inputs and checks the output signal of the comparator 503*b*, and does not check the output signal of the comparator 503*a*. The impedance of the electrostatic shielding member 112 whose conduction condition is excellent is low, and the potential of the inverting input terminal of the comparator 503*b* is lower than a threshold value (the second reference voltage Vref2). The impedance of the electrostatic shielding member 112 whose conduction condition is deteriorated is high, and the potential of the inverting input terminal of the comparator 503*b* is higher than the threshold value (the second reference voltage Vref2). When the induction heating coil 101 is stopped, in a case where the level of the output signal of the comparator 503*b* is high (+5 V), the control portion 104 determines that the conduction condition of the electrostatic shielding member 112 is excellent, and permits the induction heating coil 101 to be energized. In a case where the level of the output signal of the comparator 503*b* is low (0 V), the control portion 104 determines that the conduction condition of the electrostatic shielding member 112 is deteriorated, and holds the induction heating coil 101 in the stopped state (does not permit it to be energized).

When the induction heating coil 101 is operating (energized), the control portion 104 inputs and checks the output signal of the comparator 503*a*, and does not check the output signal of the comparator 503*b*. In the energized state, leakage current (operating frequency component) flows as a large noise from the induction heating coil 101 to the electrostatic shielding member 112. In the second embodiment, when the induction heating coil 101 is operating, due to the large noise of the leakage current (operating frequency component), the comparator 503*b* outputs a low level also when the conduction condition of the electrostatic shielding member 112 is excellent. Therefore, when the induction heating coil 101 is operating, the output signal of the comparator 503*b* is not useful as data for determining the conduction condition of the electrostatic shielding member 112.

In the energized state, the control portion 104 uses the output signal of the comparator 503*a*. When the conduction condition of the electrostatic shielding member 112 is excellent, a large leakage current flows as noise from the induction heating coil 101 to the electrostatic shielding member. Therefore, the potential of the non-inverting input terminal of the comparator 503*a* is higher than a threshold value (first reference voltage Vref1). For example, when the electrostatic shielding member 112 is broken, the leakage current (noise) flowing from the induction heating coil 101 to the electrostatic shielding member is small. Therefore, the potential of the non-inverting input terminal of the comparator 503*a* is lower than the threshold value (first reference voltage Vref1). The comparator 503*a* outputs a high level when the conduction condition of the electrostatic shielding member 112 is excellent. When the induction heating coil 101 is operating (energized), in a case where the level of the output signal of the comparator 503*a* is high (+5 V), the control portion 104 determines that the conduction condition of the electrostatic shielding member 112 is excellent, and keeps the energized state of the induction heating coil 101. In a case where the level of the output signal of the comparator 503*a* is low (0 V), the control portion 104 determines that the conduction condition of the electrostatic shielding member 112 is deteriorated, and stops the induction heating coil 101. The leakage current flowing through the electrostatic shielding member 112 having a large area is large and its level is not stable (like noise). In such a case, the sensing portion 503 operates more stably when the detection voltage based on the leakage current is compared with a predetermined threshold value than when it is compared with a reference voltage proportional to the output level of the induction heating coil (for example, the Official Gazette of Japanese Unexamined Patent Publication No. Sho 62-278785).

With the above-described structure, both while the induction heating coil is stopped and while it is operating, the conduction condition of the electrostatic shielding member is sensed by a method appropriate for each of these cases, and the induction heating coil can be appropriately controlled. A safe induction heating apparatus can be realized.

The microcomputer 105 executes the function of the control portion 104 by software processing. In the software processing, from the input of the signal to the output of the processing result, a delay of up to the processing cycle period is caused. In a case where the top plate, for example, cracks when the induction heating coil 101 is energized (in this case, the conduction condition of the electrostatic shielding member 112 is deteriorated), it is preferable to stop the induction heating coil 101 as soon as possible. In the second embodiment, when the induction heating coil 101 is energized, the microcomputer 105 inputs the output signal of the comparator 503*a* (the sensing output when the induction heating coil 101 is operating) to an external interruption terminal. When the level of the output signal of the comparator 503*a* is changed from high to low, the microcomputer 105 immediately executes interruption processing, and stops the induction heating coil 101. By this, high safety is realized. The microcomputer 105 inputs the output signal of the comparator 503*b* (the sensing output when the induction heating coil 101 is stopped) to the normal input terminal, and processes it every processing cycle period.

Figure 6:
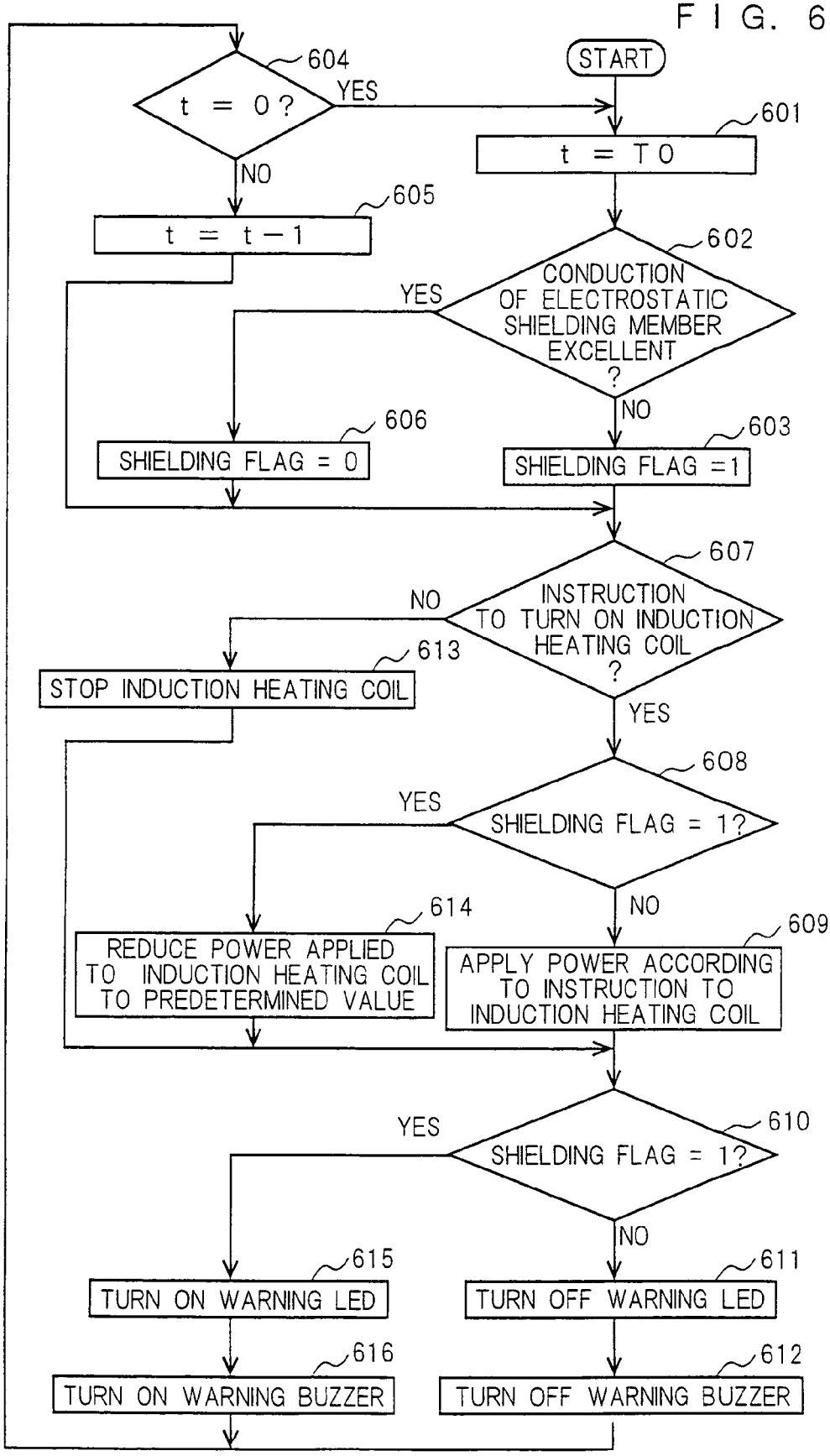
FIG. 6 is a flowchart showing the control method of the induction heating apparatus of the second embodiment of the present invention.

FIG. 6 is a flowchart showing a control method of the induction heating apparatus of the second embodiment. FIG. 6 has steps 601 to 616. First, the time t is set to T0 (in the second embodiment, T0=10 seconds) (step 601). Then, the control portion 104 checks whether the conduction condition of the electrostatic shielding member 112 is excellent or not (when the induction heating coil 101 is stopped, whether the output of the comparator 503*b* is +5 V or 0 V, and when the induction heating coil 101 is operating, whether the output of the comparator 503*a* is +5 V or 0 V) (step 602). Only at step 602, the sensing portion 503 consumes power. When the conduction condition is excellent, the process proceeds to step 606, and the shielding flag is set to 0. When the conduction condition is poor, the process proceeds to step 603, and the shielding flag is set to 1. The process proceeds to step 607.

At step 607, the control portion 104 checks whether an instruction to turn on the induction heating coil 101 is inputted or not. When the instruction to turn on the induction heating coil 101 is not inputted (when an instruction to turn off the induction heating coil 101 is inputted), the induction heating coil 101 is stopped (step 613). The process proceeds to step 610. When the instruction to turn on the induction heating coil 101 is inputted (step 607), whether the shielding flag is 1 or not is checked (step 608). When the shielding flag is 1 (when the conduction condition is poor), the voltage applied to the induction heating coil 101 is reduced to not more than a predetermined level (step 614). In the second embodiment, the induction heating coil 101 is stopped. A low power may be applied to the induction heating coil 101. When the shielding flag is 0 (when the conduction condition is excellent), the control portion 104 controls so that the inverter circuit 102 applies power according to the instruction to the induction heating coil 101 (step 609). The process proceeds to step 610.

At step 610, whether the shielding flag is 1 or not is checked. When the shielding flag is 1 (when the conduction condition is poor), the warning LED 116 is turned on (step 615), and the warning buzzer 115 is turned on (step 616). The process proceeds to step 604. When the shielding flag is 0 (when the conduction condition is excellent), the warning LED 116 is turned off (step 611), and the warning buzzer 115 is turned off (step 612). The process proceeds to step 604.

At step 604, whether t=0 or not is determined (In actuality, steps 604 and 605 are executed every predetermined time.). When t=0, the process proceeds to step 601, and the above-described processing is repeated. When t is not 0, the value of t is decremented (step 605). The process proceeds to step 607, and the above-described processing is repeated.

The sensing portion checks the conduction condition of the electrostatic shielding member 112 every predetermined time and the power supply to the sensing portion 503 is stopped except when the sensing portion 503 is performing the check, whereby the average power consumption of the induction heating apparatus can be reduced.

The sensing portion may switch between sensing the conduction condition of the electrostatic shielding member in real time and sensing it intermittently according to the load sensing. By this, the apparatus is hardly affected by noise, so that an accurate sensing result can be outputted with stability.

When the induction heating coil 101 is energized, there are cases where it is preferable that the sensing portion 503 quickly senses the conduction condition of the inverter circuit 102. The following may be performed: when the induction heating coil 101 is energized, the sensing portion 503 checks the conduction condition of the electrostatic shielding member 112 in real time (for example, by interruption processing); and when the induction heating coil 101 is not energized, the sensing portion 503 checks the conduction condition of the electrostatic shielding member 112 every predetermined time.

In the second embodiment, the sensing portion 503 senses the conduction condition of the electrostatic shielding member 112 every predetermined time T0 while the induction heating coil is energized or stopped. The sensing portion 503 may sense the conduction condition of the electrostatic shielding member 112 when the induction heating coil is turned from off to on and every predetermined time T0 while the induction heating coil is energized.

The following may be performed: when the comparator 503*b* determines whether the impedance of the electrostatic shielding member 112 is not more than a predetermined threshold value or not and the control portion 104 reduces or stops the output of the induction heating coil 101 when the impedance of the electrostatic shielding member 112 is higher than the predetermined threshold value.

The following may be performed: the comparator 503*b* determines whether the voltage across the electrostatic shielding member 112 is not more than a predetermined threshold value or not; and the control portion 104 reduces or stops the output of the induction heating coil 101 when the voltage across the electrostatic shielding member 112 is higher than the predetermined threshold value.

The following may be performed: the comparator 503*b* determines whether the current flowing through the electrostatic shielding member 112 is not less than a predetermined threshold value or not; and the control portion 104 reduces or stops the output of the induction heating coil 101 when the current flowing through the electrostatic shielding member 112 is smaller than the predetermined threshold value.

In the present embodiment, one end of the induction heating coil 101 is directly connected to the ground wire of the inverter circuit 102. No leakage current flows from the side directly connected to the ground wire of the induction heating coil 101 to the user through the object 110 to be heated. Shielding is performed so that no leakage current flows from the other end of the induction heating coil 101 to the object 110 to be heated. In the present structure, shielding between the induction heating coil 101 and the object 110 to be heated is easy, so that a higher shielding effect is obtained.

<<Third Embodiment>>

An induction heating apparatus of a third embodiment of the present invention will be described referring to FIG. 7. The schematic structure (FIG. 1) and the circuit structure (FIG. 3) of the induction heating apparatus of the third embodiment is the same as those of the first embodiment. The induction heating apparatus of the third embodiment is capable of heating high-permeability (magnetic) objects to be heated, such as iron (or low-permeability and high-resistance objects to be heated, such as 18-8 stainless steel) and low-permeability (non-magnetic) and low-resistance objects to be heated, such as aluminum or copper. The induction heating apparatus of the third embodiment is different from that of the first embodiment only in the control method associated with the sensing of the conduction condition of the electrostatic shielding member 112. Except this, the third embodiment is the same as the first embodiment. Since the basic structure of the present embodiment is the same as that of the first embodiment, different points will be mainly described. The same functions as those of the first embodiment are denoted by the same reference numerals and descriptions thereof are omitted.

Figure 7:
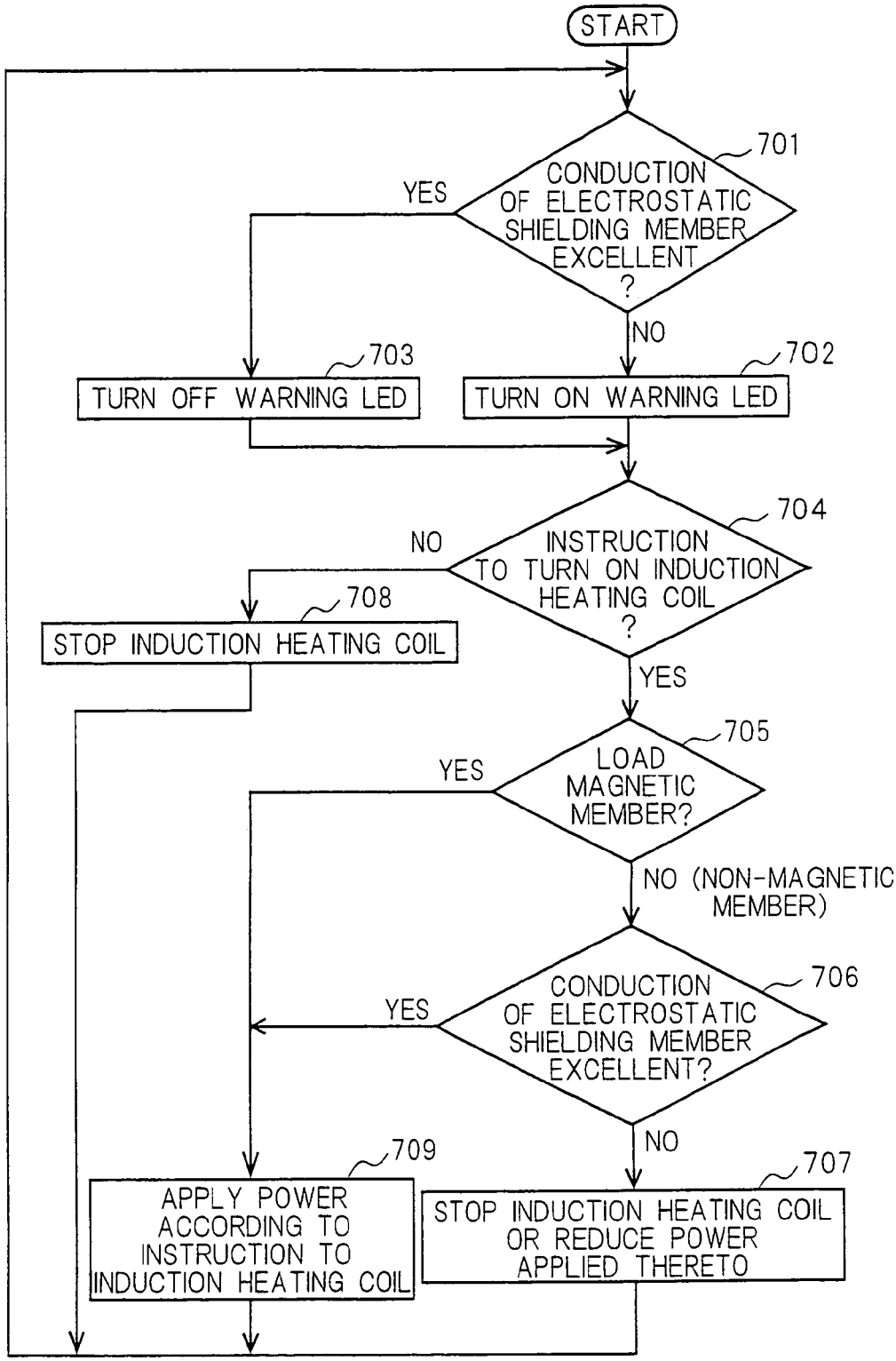
FIG. 7 is a flowchart showing the control method of an induction heating apparatus of a third embodiment of the present invention.

FIG. 7 is a flowchart showing the control method of the induction heating apparatus of the third embodiment. FIG. 7 has steps 701 to 709. First, the control portion 104 checks whether the conduction condition of the electrostatic shielding member 112 is excellent or not (whether the collector potential of the transistor 103*a* is +5 V or 0 V) (step 701). When the conduction condition is excellent, the warning LED 116 is turned off (step 703), and when the conduction condition is poor, the warning LED 116 is turned on (step 702). The process proceeds to step 704.

At step 704, the control portion 104 checks whether an instruction to turn on the induction heating coil 101 is provided or not. When the instruction to turn on the induction heating coil 101 is provided, the process proceeds to step 705. When the instruction to turn on the induction heating coil 101 is not provided, the process proceeds to step 708.

At step 708, the induction heating coil 101 is stopped. The process returns to step 701, and the above-described processing is repeated.

At step 705, the control portion 104 checks whether the load (object 110 to be heated) of the induction heating coil 101 is a magnetic member (or a low-permeability and high-resistance object to be heated) or not. When the load (object 110 to be heated) is a magnetic member (or a low-permeability and high-resistance object to be heated), the process proceeds to step 709, and when the load (object 110 to be heated) is not a magnetic member (or a low-permeability and high-resistance object to be heated) (is a low-permeability (magnetic) and low-resistance object to be heated), the process proceeds to step 706.

At step 706, the control portion 104 checks whether the conduction of the electrostatic shielding member 112 is excellent or not based on the output of the sensing portion 103. When the conduction of the electrostatic shielding member 112 is excellent, the process proceeds to step 709, and power according to the instruction is applied to the induction heating coil 101. The process returns to step 701, and the above-described processing is repeated.

At step 706, when the conduction of the electrostatic shielding member 112 is deteriorated, the process proceeds to step 707, the induction heating coil 101 is stopped or the power applied thereto is reduced. The process returns to step 701, and the above-described processing is repeated.

It is particularly a problem that leakage current flows from the induction heating coil 101 to the user through the object 110 to be heated when the object to be heated is non-magnetic and low in resistance. In the present structure, only when the object 110 to be heated is non-magnetic and low in resistance and the conduction of the electrostatic shielding member 112 is deteriorated, for example, the output of the induction heating coil 101 is reduced or stopped. It does not readily occur that the sensing portion 103 makes a mis-sensing and inconveniences the user when the electrostatic shielding member 112 has an excellent conduction condition. An induction heating apparatus that appropriately operates the safety function is realized.

In the third embodiment, the operations of the warning LED 116 and the warning buzzer 115 are the same as those of the first embodiment. Instead of this, that the induction heating apparatus cannot be used may be indicated by turning on the warning LED 116 and/or notified by turning on the warning buzzer 115 only when the conduction condition of the electrostatic shielding member 112 is deteriorated and the object 110 to be heated is non-magnetic and low in resistance. That the induction heating apparatus cannot be used can be accurately notified to the user only when the object to be heated is non-magnetic and low in resistance. The user can properly use and repair the induction heating apparatus.

<<Fourth Embodiment>>

An induction heating apparatus of a fourth embodiment of the present invention will be described referring to FIG. 8. The induction heating apparatus of the fourth embodiment is different from that of the first embodiment only in the attachment method of the electrostatic shielding member 112. Except this, the fourth embodiment is the same as the first embodiment. Since the basic structure of the present embodiment is the same as that of the first embodiment, different points will be mainly described. The same functions as those of the first embodiment are denoted by the same reference numerals and descriptions thereof are omitted.

Figure 8:
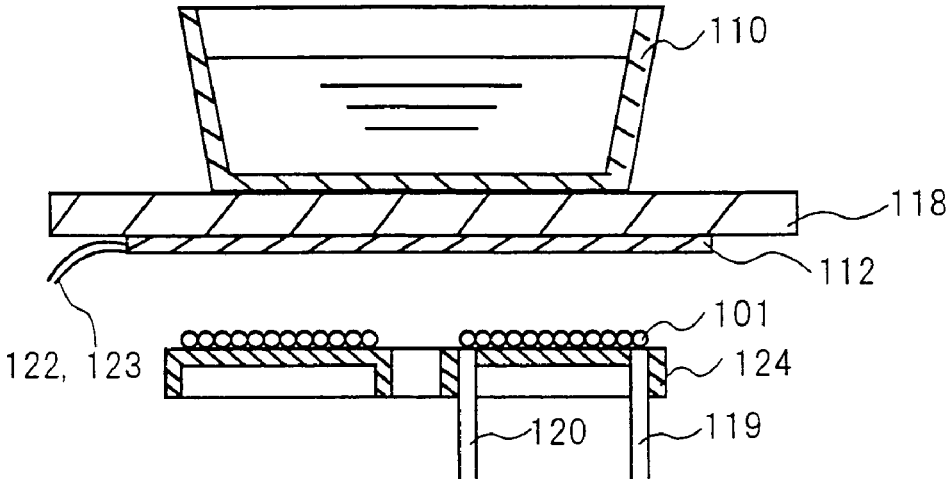
FIG. 8 is a cross-sectional view of a relevant part of an induction heating apparatus of a fourth embodiment of the present invention.

FIG. 8 is a cross-sectional view of a relevant part of the induction heating apparatus of the fourth embodiment (only the neighborhood of the attachment position of the electrostatic shielding member 112 is shown). In FIG. 8, the electrostatic shielding member 112 is provided on the undersurface of the top plate 118. When there is a sufficient space between the electrostatic shielding member 112 and the induction heating coil 101, it is not always necessary to provide the insulating layer 117 covering the electrostatic shielding member 112.

The shielding member can be stably provided in the vicinity of the object to be heated, so that shielding between the induction heating coil and the object to be heated is ensured.

The electrostatic shielding member 112 may be provided on the top surface and the undersurface of the top plate 118.

<<Fifth Embodiment>>

An induction heating apparatus of a fifth embodiment of the present invention will be described referring to FIG. 9. The induction heating apparatus of the fifth embodiment has a top plate 918 made of laminated glass instead of the top plate 118, and is different from that of the first embodiment in the attachment method of the electrostatic shielding member 112. Except this, the fifth embodiment is the same as the first embodiment. Since the basic structure of the present embodiment is the same as that of the first embodiment, different points will be mainly described. The same functions as those of the first embodiment are denoted by the same reference numerals and descriptions thereof are omitted.

Figure 9:
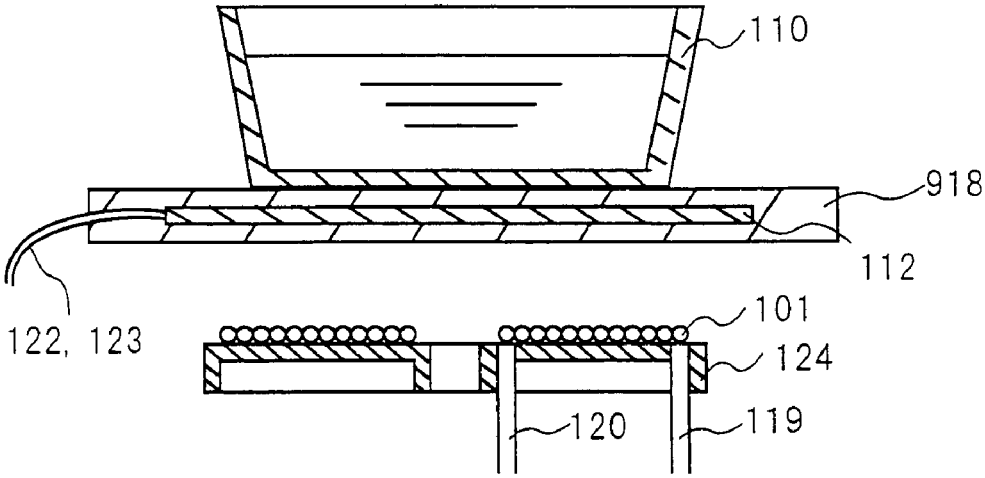
FIG. 9 is a cross-sectional view of a relevant part of an induction heating apparatus of a fifth embodiment of the present invention.

FIG. 9 is a cross-sectional view of a relevant part of the induction heating apparatus of the fifth embodiment (only the neighborhood of the attachment position of the electrostatic shielding member 112 is shown). In FIG. 9, the electrostatic shielding member 112 is provided between the glass panes of the top plate 918 made of laminated glass. The electrostatic shielding member 112 is securely held by the laminated glass. Since the electrostatic shielding member 112 is extremely thin, substantially no space is formed between the two glass panes. The shielding member can be stably provided in the vicinity of the object to be heated. The shielding member is reliably insulated from the object to be heated and the induction heating coil without the provision of an insulating layer.

<<Sixth Embodiment>>

An induction heating apparatus of a sixth embodiment of the present invention will be described referring to FIG. 10. In the induction heating apparatus of the sixth embodiment, a fixing plate 1001 is provided between the induction heating coil 101 and the object 110 to be heated, and the electrostatic shielding member 112 is provided on the top surface of the fixing plate 1001. Except this, the sixth embodiment is the same as the first embodiment. Since the basic structure of the present embodiment is the same as that of the first embodiment, different points will be mainly described. The same functions as those of the first embodiment are denoted by the same reference numerals and descriptions thereof are omitted.

Figure 10:
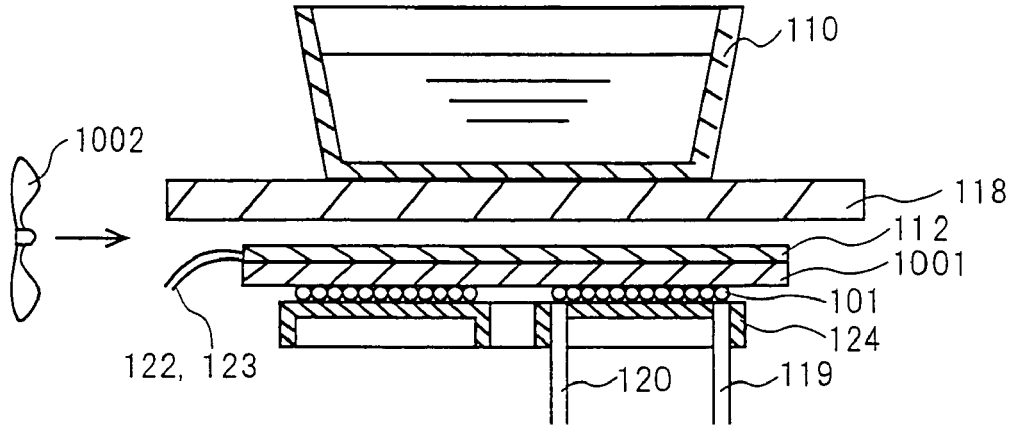
FIG. 10 is a cross-sectional view of a relevant part of an induction heating apparatus of a sixth embodiment of the present invention.

FIG. 10 is a cross-sectional view of a relevant part of the induction heating apparatus of the sixth embodiment (only the neighborhood of the attachment positions of the fixing plate 1001 and the electrostatic shielding member 112 is shown). In FIG. 10, the fixing plate 1001 is made of heatproof withstand insulation glass, ceramics, mica, a heatproof resin or the like, and the electrostatic shielding member 112 is provided on the top surface thereof. The fixing plate 1001 is mounted on the induction heating coil 101. Since the fixing plate 1001 is made of a heatproof withstand insulation material, there is no possibility that it is deteriorated by heat due to a long period of use.

A space is provided between the fixing plate 1001 and the top plate 118. A wind generated by a cooling fan 1002 passes through this space directly or by being guided by an air guide. By this, the induction heating coil 101 can be cooled.

It is possible to form a standard fixing plate 1001 on the top surface of which the electrostatic shielding member 112 is provided and freely dispose the standard fixing plate in an arbitrary appropriate position for each type of induction heating apparatus. The attachment position of the fixing plate is determined for each type of apparatus, and the product design can be standardized. The labor and period of development can be reduced.

<<Seventh Embodiment>>

An induction heating apparatus of a seventh embodiment of the present invention will be described referring to FIG. 11. In the induction heating apparatus of the seventh embodiment, space is provided between the fixing plate 1001 and the induction heating coil 101. Except this, the seventh embodiment is the same as the sixth embodiment.

Figure 11:
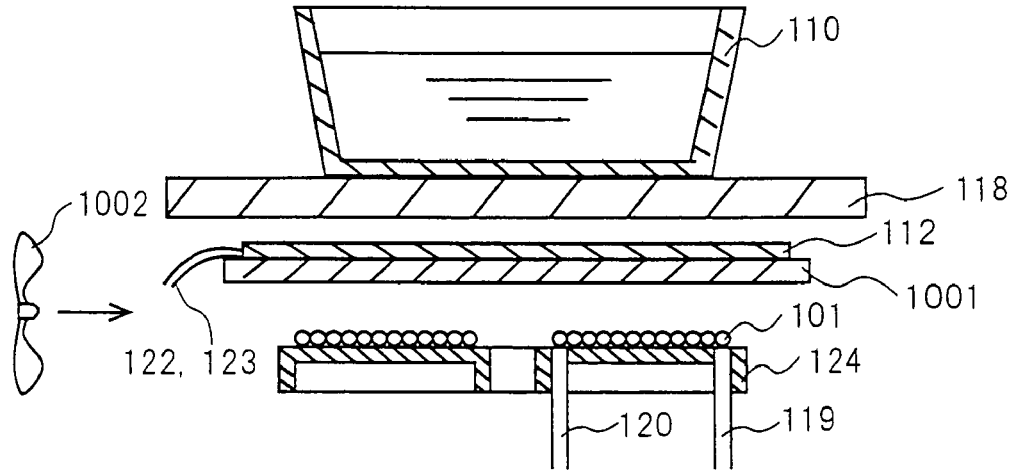
FIG. 11 is a cross-sectional view of a relevant part of an induction heating apparatus of a seventh embodiment of the present invention.

FIG. 11 is a cross-sectional view of a relevant part of the induction heating apparatus of the seventh embodiment (only the neighborhood of the attachment position of the fixing plate 1001 and the electrostatic shielding member 112 is shown). In FIG. 11, since the space is provided between the fixing plate 1001 and the induction heating coil 101, the insulating performance of the fixing plate 1001 may be low compared to that of the sixth embodiment. The fixing plate 1001 may be made of an inexpensive insulating material.

The heat radiating performance of the surface of the induction heating coil 101 of the seventh embodiment is high compared to that of the sixth embodiment. A wind generated by the cooling fan 1002 passes through the space directly or by being guided by an air guide. By this, the induction heating coil 101 can be further cooled.

<<Eighth Embodiment>>

An induction heating apparatus of an eighth embodiment of the present invention will be described referring to FIG. 12. The induction heating apparatus of the eighth embodiment is different from the seventh embodiment in providing a fixing plate 1201 instead of the fixing plate 1001 and the attachment method of the electrostatic shielding member 112. Except this, the eighth embodiment is the same as the seventh embodiment.

Figure 12:
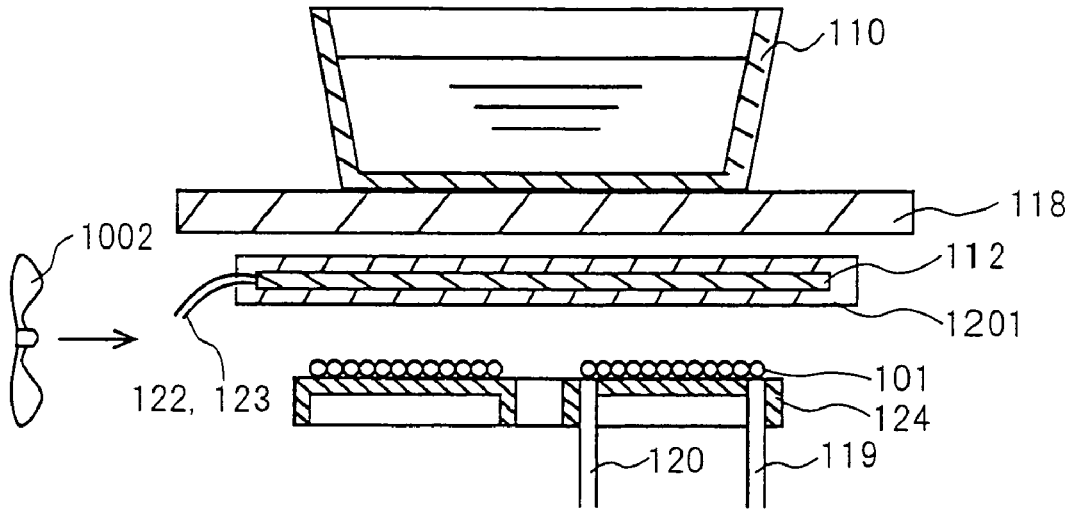
FIG. 12 is a cross-sectional view of a relevant part of an induction heating apparatus of an eighth embodiment of the present invention.

FIG. 12 is a cross-sectional view of a relevant part of the induction heating apparatus of the eighth embodiment (only the neighborhood of the attachment positions of the fixing plate 1201 and the electrostatic shielding member 112 is shown). In FIG. 12, the fixing plate 1201 is made by bonding thin plates comprising two panes of heatproof withstand insulation glass, ceramics, mica, a heatproof resin or the like. The electrostatic shielding member 112 is provided between the two thin plates.

<<Ninth Embodiment>>

Figure 13:
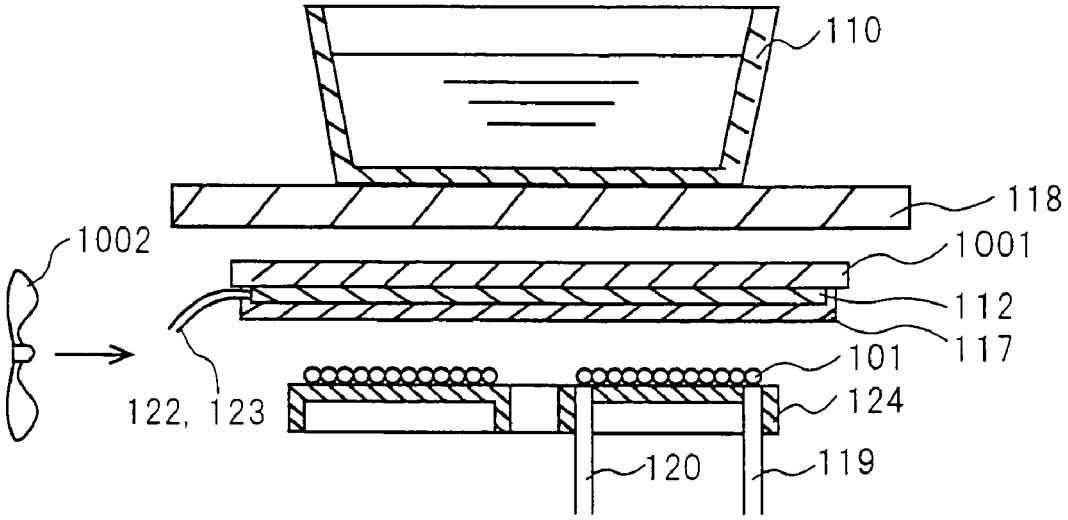
FIG. 13 is a cross-sectional view of a relevant part of an induction heating apparatus of a ninth embodiment of the present invention.
Figure 14:
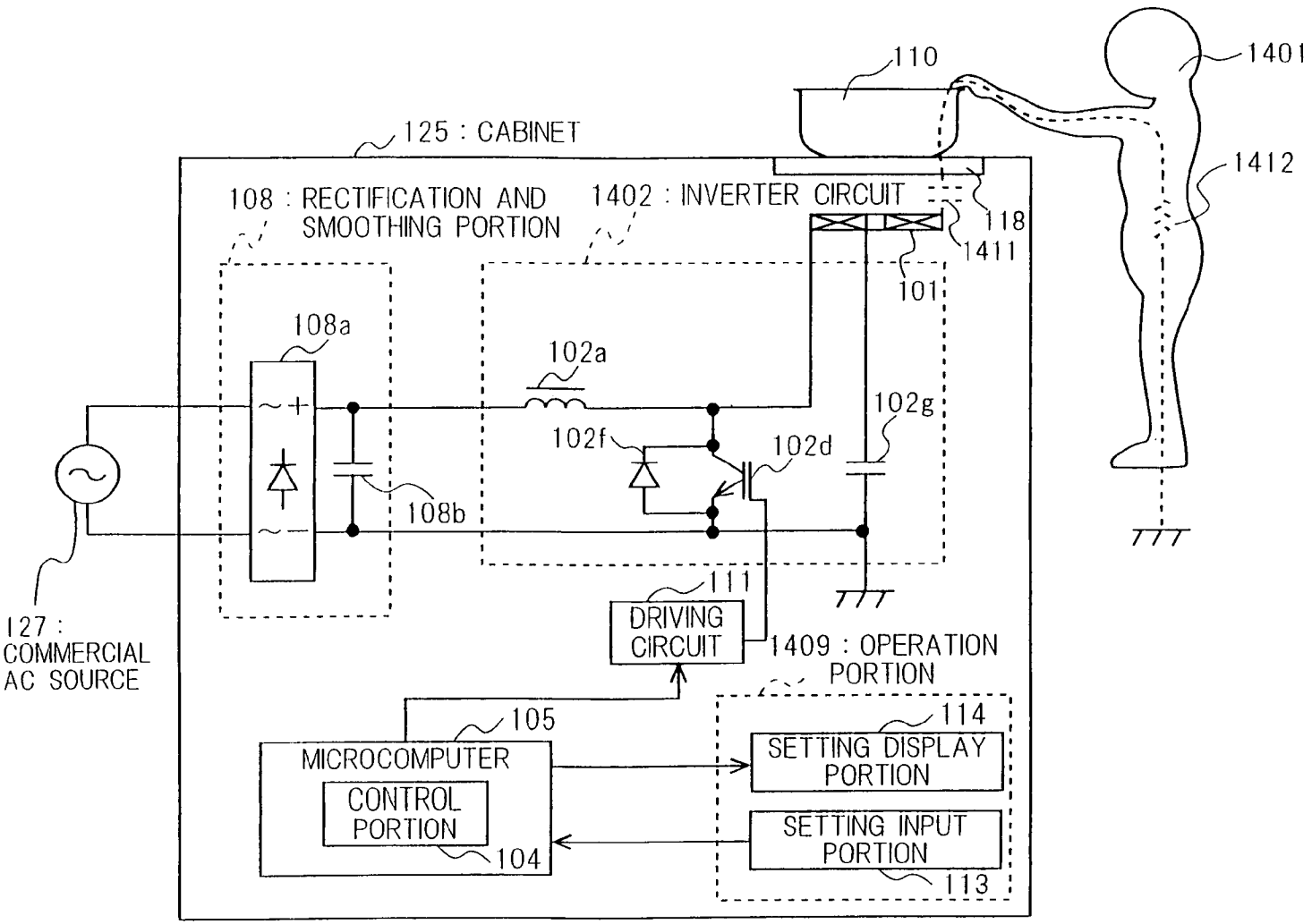
BACKGROUND ART FIG. 14
FIG. 14 is the block diagram showing the structure of the induction heating apparatus of the first conventional example.
Figure 15:
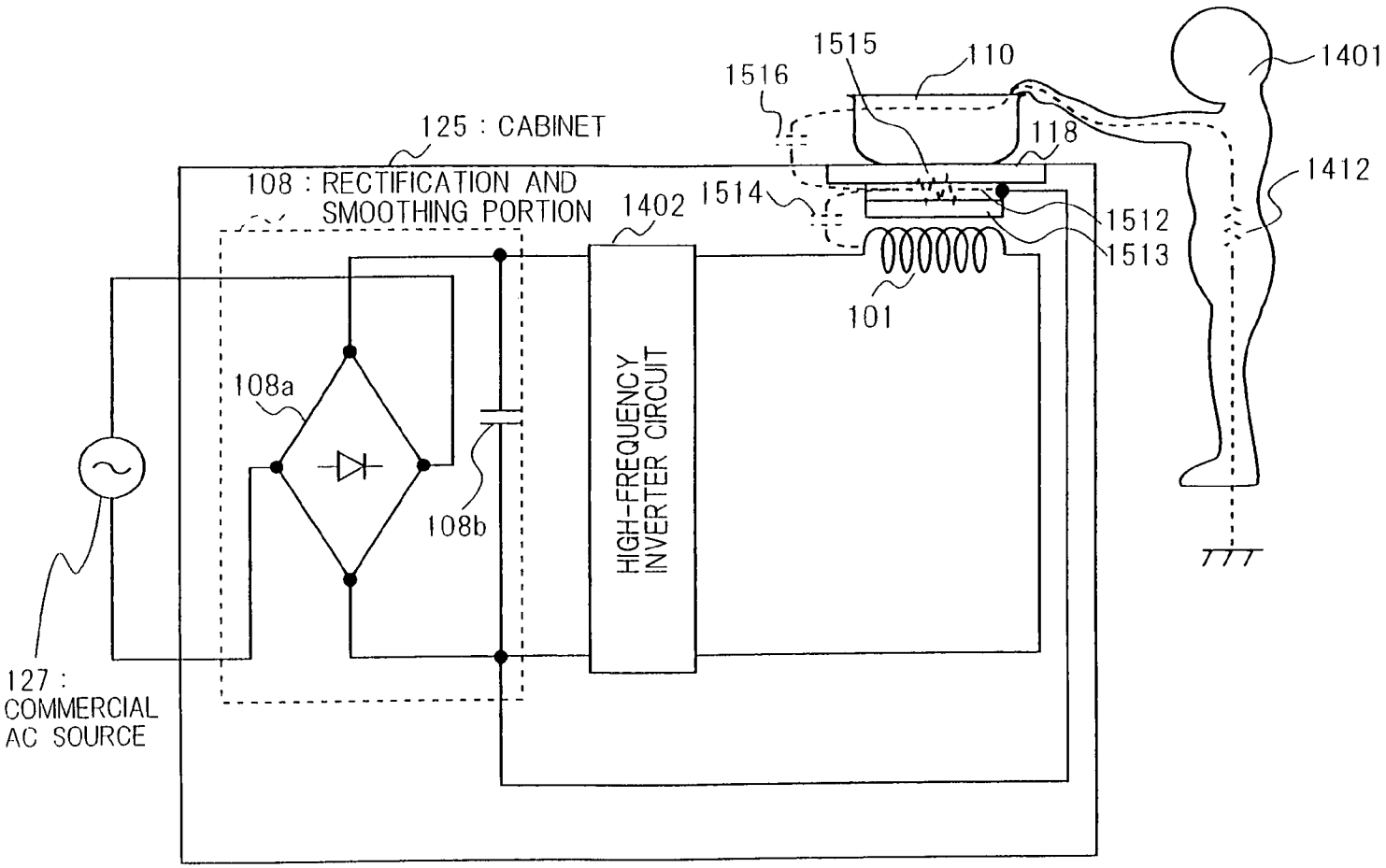
BACKGROUND ART FIG. 15
FIG. 15 is the block diagram showing the structure of the induction heating apparatus of the second conventional example.
Figure 16:
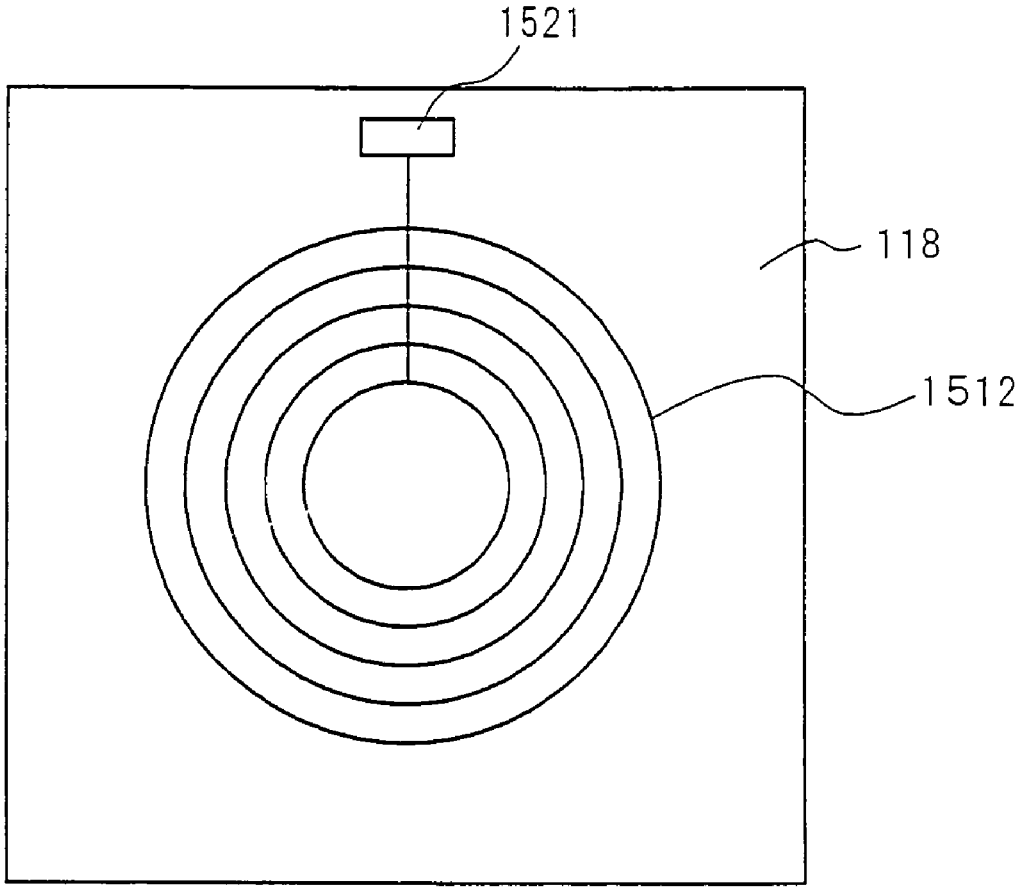
BACKGROUND ART FIG. 16
FIG. 16 is the view showing the pattern of the electrostatic shielding member formed on the top plate of the induction heating apparatus of the second conventional example.

An induction heating apparatus of a ninth embodiment of the present invention will be described referring to FIG. 13. The induction heating apparatus of the ninth embodiment has the electrostatic shielding member 112 on the undersurface of the fixing plate 1001, and the insulating layer 117 covering the electrostatic shielding member 112. Except this, the ninth embodiment is the same as the seventh embodiment. While the insulating layer 117 is provided in the ninth embodiment, when there is a sufficient air clearance between the fixing plate 1001 and the induction heating coil 101, the insulating layer 117 covering the electrostatic shielding member 112 may be deleted.

In the above-described embodiments, induction heating apparatuses in which the object to be heated is placed on the top plate are described. The present invention is not limited thereto, but is applicable, for example, to: an induction heating apparatus in which the object to be heated is held in the air; an induction heating apparatus in which a trivet, a cover or the like made of an insulating heatproof material such as a synthetic resin, ceramics or glass is provided on the induction heating coil and the object to be heated is placed thereon; and an induction heating apparatus in which a hole is provided in an insulating heatproof material and the object to be heated is fitted in the hole. In the induction heating apparatuses of these structures, the heating efficiency can be enhanced by shortening the distance between the induction heating coil and the object to be heated.

The size of the pattern of the electrostatic shielding member 112 of the present embodiments is substantially similar to that of the induction heating coil 101, and its shape is a substantially arc shape split by the slit 201. While this shape is preferable, the present invention is not limited thereto, but the shape may be any shape that has a size covering the electrostatic shielding member and the high-voltage part of the induction heating coil 101. For example, the shape may be a rectangular or a doughnut shape.

The electrostatic shielding member 112 of the present embodiments has the connection portion 202 at each of both ends of the pattern. The connection portions 202 are connected to the sensing portion 103 through the lead wires 122 and 123, respectively. Any other structure may be used as long as two or more connection portions are provided, power is applied between the connection portions from the sensing portion and the conduction condition of the electrostatic shielding member is sensed. By providing two or more connection portions, not only it is easy for the sensing portion to sense the conduction condition of the electrostatic shielding member but also the electrostatic shielding member can produce the shielding effect even when the conduction of one wire is deteriorated.

The electrostatic shielding member and the low-potential part may be connected by the connecting wires (so that a DC component and an AC component flow) like in the embodiment, or may be alternatingly connected by a capacitor. In a case where the electrostatic shielding member and the low-potential part are connected by a capacitor, when the induction heating coil is stopped, for example, the sensing portion applies the AC voltage outputted by an oscillator circuit incorporated in the sensing portion (a voltage different from the voltage generated by the induction heating coil), and senses the conduction condition of the electrostatic shielding member.

According to the present invention, the apparatus can be made high in safety without any possibility of an electric shock even when the electrostatic shielding member does not sufficiently performing its function.

Although the invention has been described in its preferred form with a certain degree of particularity, it is understood that the present disclosure of the preferred form has been changed in the details of construction and the combination and arrangement of parts may be resorted to without departing from the scope and the spirit of the invention as hereinafter claimed.

INDUSTRIAL APPLICABILITY

The present invention is applicable to induction heating apparatuses such as induction heating cookers.

The invention claimed is:

1. An induction heating apparatus comprising:

a top plate on which an object to be heated is placed, an induction heating coil for generating a high-frequency magnetic field and heats said object to be heated;

a fixing plate placed on said induction heating coil, and made by bonding thin plates having heat proof withstand insulation;

an inverter circuit for driving said induction heating coil;

a conductive shielding member provided in said thin plates of said fixing plate, and electrically connected to a low-potential part;

a sensing portion for applying to said shielding member a voltage different from a voltage generated by said induction heating coil and sensing a conduction condition of said shielding member; and a control portion which reduces or stops the output of said inverter circuit when said sensing portion detects an abnormal conduction condition of said shielding member.

2. The induction heating apparatus according to claim 1, wherein said sensing portion determines whether an impedance of said shielding member is not more than a predetermined threshold value or not, whether a voltage between predetermined terminals of said shielding member is not more than a predetermined threshold value or not, or whether a current flowing through said shielding member is not less than a predetermined threshold value or not, and wherein said control portion reduces or stops an output of said induction heating coil when the impedance of said shielding member is higher than the predetermined threshold value, when the voltage between the predetermined terminals of said shielding member is higher than the predetermined threshold value or when the current flowing through said shielding member is smaller than the predetermined threshold value.

3. An induction heating apparatus comprising:

a top plate on which an object to be heated is placed, an induction heating coil for generating a high-frequency magnetic field and heats said object to be heated;

a fixing plate placed on said induction heating coil;

an inverter circuit for driving said induction heating coil;

a conductive shielding member provided on said fixing plate, in said fixing plate or below said fixing plate and electrically connected to a low-potential part;

a sensing portion for applying to said shielding member a voltage different from a voltage generated by said induction heating coil under a condition where said induction heating coil is not energized, and sensing a conduction condition of said shielding member;

a control portion for controlling said inverter circuit not to operate said induction heating coil from the beginning when said sensing portion detects an abnormal conduction condition of said shielding member; and a display portion for indicating the abnormal condition, and/or a notification portion for notifying the abnormal condition, when said sensing portion detects an abnormal conduction condition of said shielding member under a condition where said induction heating coil is not energized.

4. The induction heating apparatus according to claim 1, wherein said sensing portion feeds a direct current to said shielding member and senses the conduction condition of said shielding member.

5. The induction heating apparatus according to claim 1, wherein said sensing portion senses the conduction condition of said shielding member every predetermined time while said induction heating coil is energized.

6. The induction heating apparatus according to claim 1, wherein said shielding member and said sensing portion are connected by at least two connecting wires, and said sensing portion senses the conduction condition of a path including at least two of said connecting wires and at least part of said shielding member.

7. The induction heating apparatus according to claim 1, wherein said shielding member has a shape in which a closed loop including a central axis of said induction heating coil is absent thereon.

8. The induction heating apparatus according to claim 7, wherein said shielding member has a substantially arc shape that is coaxial with said induction heating coil and substantially covers said induction heating coil.

* * * * *